US009480292B1

(12) United States Patent
Kazmierczak

(10) Patent No.: US 9,480,292 B1
(45) **Date of Patent: *Nov. 1, 2016**

(54) HEADWEAR WITH ENHANCED VENTILATION AND/OR WATER/PERSPIRATION HANDLING FEATURES

(71) Applicant: Alex Kazmierczak, Seattle, WA (US)

(72) Inventor: Alex Kazmierczak, Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/216,941

(22) Filed: Mar. 17, 2014

Related U.S. Application Data

(60) Provisional application No. 61/798,639, filed on Mar. 15, 2013.

(51) Int. Cl.
*A42B 1/18* (2006.01)
*A42B 1/00* (2006.01)

(52) U.S. Cl.
CPC *A42B 1/008* (2013.01); *A42B 1/18* (2013.01)

(58) Field of Classification Search
CPC ..... A42C 5/04; A42B 1/02; A42B 1/205; A42B 1/062; A42B 1/066; A42B 3/28
See application file for complete search history.

(56) References Cited

U.S. PATENT DOCUMENTS

| | | | | | |
|---|---|---|---|---|---|
| 2,416,062 | A * | 2/1947 | Mercer | 2/175.5 |
| 3,780,382 | A * | 12/1973 | Boden | 2/182.6 |
| 4,114,201 | A * | 9/1978 | Garrison | 2/209.7 |
| D271,250 | S * | 11/1983 | Burgin et al. | D2/875 |
| 5,495,622 | A * | 3/1996 | Kaufman | 2/175.1 |
| 7,143,451 | B2 * | 12/2006 | Lundgren | 2/171.3 |
| 8,516,617 | B1 * | 8/2013 | Kazmierczak | 2/181 |
| 2002/0189002 | A1 * | 12/2002 | Porter | 2/195.3 |
| 2007/0079423 | A1 * | 4/2007 | Flatt | 2/181.6 |
| 2011/0016611 | A1 * | 1/2011 | Rogers | 2/171.3 |

* cited by examiner

*Primary Examiner* — Bobby Muromoto, Jr.
(74) *Attorney, Agent, or Firm* — Christensen O'Connor Johnson Kindness PLLC

(57) ABSTRACT

Head coverings, such as hats, visors, bandanas, etc., are provided, each of which include a perspiration removal system. In some examples, the head covering may additionally or alternatively include one or more ventilation systems aimed to provide a cooling feature thereto.

20 Claims, 24 Drawing Sheets

HEADWEAR WITH ENHANCED VENTILATION AND/OR WATER/PERSPIRATION HANDLING FEATURES

CROSS-REFERENCE TO RELATED APPLICATION

This application claims the benefit of U.S. Provisional Application No. 61/798,639, filed Mar. 15, 2013, the subject matter of which is hereby incorporated in its entirety.

BACKGROUND

As generally known, hats provide many benefits to the wearer, including shade to protect the user's head from the direct rays of the sun. Such shade reduces glare to the wearer's eyes, protects certain areas of the wearer's body from sunburn, may reduce the effects of heat to the wearer, etc. In other instances, the hat may protect the wearer from rain, sleet, snow, and other precipitation, and/or may provide protection from the cold, wind, etc.

While the sun's rays to some degree are blocked from the wearer's head, radiant energy is absorbed by the hat and is generally conducted through the crown of the hat into the interior cavity of the hat, thereby heating the wearer's head. In conjunction with such heat being absorbed, heat generated by the wearer's body radiates outwardly from the head, which can be somewhat trapped by the crown portion of the hat and retained in close proximity to the wearer's head. Therefore, the wearer is sometimes faced with the dichotomy of wearing a hat to protect from certain conditions, such as rain, wind, glare, sunburns, etc., only to result in an increased body temperatures to the wearer due to the heat absorbed and retained by the crown.

Several conventional hats have been provided with ventilating holes through the top and/or side walls of the crown for accessing the interior cavity, or the crown was constructed out of mesh to reduce this buildup of heat. Unfortunately, such efforts have had limited success in eliminating the problem of heat buildup within the interior of hats, while creating further problems such as diminishing the ability to protect the wearer from other conditions, such as rain, wind, etc.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with aspects of the present disclosure, a head covering is provided. The head covering includes a crown having an open ended cavity configured to receive a head of a user, wherein the crown includes an inner crown wall disposed adjacent to a head of a user when the head covering is worn, an outer crown wall spaced a distance outwardly from the inner crown wall, and a top section. The outer crown wall in one embodiment includes an upwardly extending first section and a second section that extends from an upper portion of the first section to one of the top section and the inner crown wall in an upwardly sloping manner. The head covering also includes a ventilation system associated with the crown and configured to provide ventilation to a user of the head covering. The ventilation system in one embodiment includes (1) at least one chamber disposed between the inner crown wall and the outer crown wall, (2) at least one first chamber opening disposed in the inner crown wall and connecting the at least one first chamber in fluid communication with the open ended cavity, (3) at least one second chamber opening disposed in the second section of the outer crown wall and connecting the at least one first chamber in fluid communication with an exterior of the head covering, and (4) at least one third chamber opening disposed below the at least one chamber and connected in fluid communication with the at least one first chamber.

In accordance with another aspect of the present disclosure, a head covering is provided. The head covering includes an inner wall section and an outer wall section disposed radially outwardly of the inner wall section and coupled thereto in order to form a channel. The head covering also includes means for sealing against the head of the user. The sealing means in some embodiments is configured for directing liquid into the channel.

In accordance with another aspect of the present disclosure, a head covering is provided. The head covering includes a hat body having a brim and a crown, means for ventilating the hat, and means for collecting moisture from a user when the head covering is being worn.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

Example embodiments of the present disclosure will now be described with reference to the accompanying drawings where like numerals correspond to like elements. Representative examples of the present disclosure are directed to head coverings, including but not limited to hats, visors, bandanas, etc., some suitable for use in outdoor applications. In particular, some embodiments of the present disclosure are directed to head coverings that provide protection from the elements, e.g., rain, wind, sun, while used in outdoor activities, including recreational activities (e.g., running, climbing, hiking, etc.), laborious activities (landscaping, construction, painting, etc.). Some embodiments of the present disclosure are also directed to head coverings having enhanced ventilation features so that the hat may regulate heat that is either absorbed by the hat or generated by the head of the user and retained thereby, while continuing to provide protection to the user from the elements. Some embodiments of the present disclosure are further directed to head coverings having perspiration removal features.

The following discussion proceeds with reference to examples of head coverings with enhanced ventilation features and/or perspiration removal features. While these examples provided herein have been described in various details, it will be apparent to one skilled in the art that this is done for illustrative purposes only and should not be construed as limiting the scope of the claimed subject matter. Further, it will be appreciated that embodiments of the present disclosure may employ any combination of features described herein.

Figure 1:
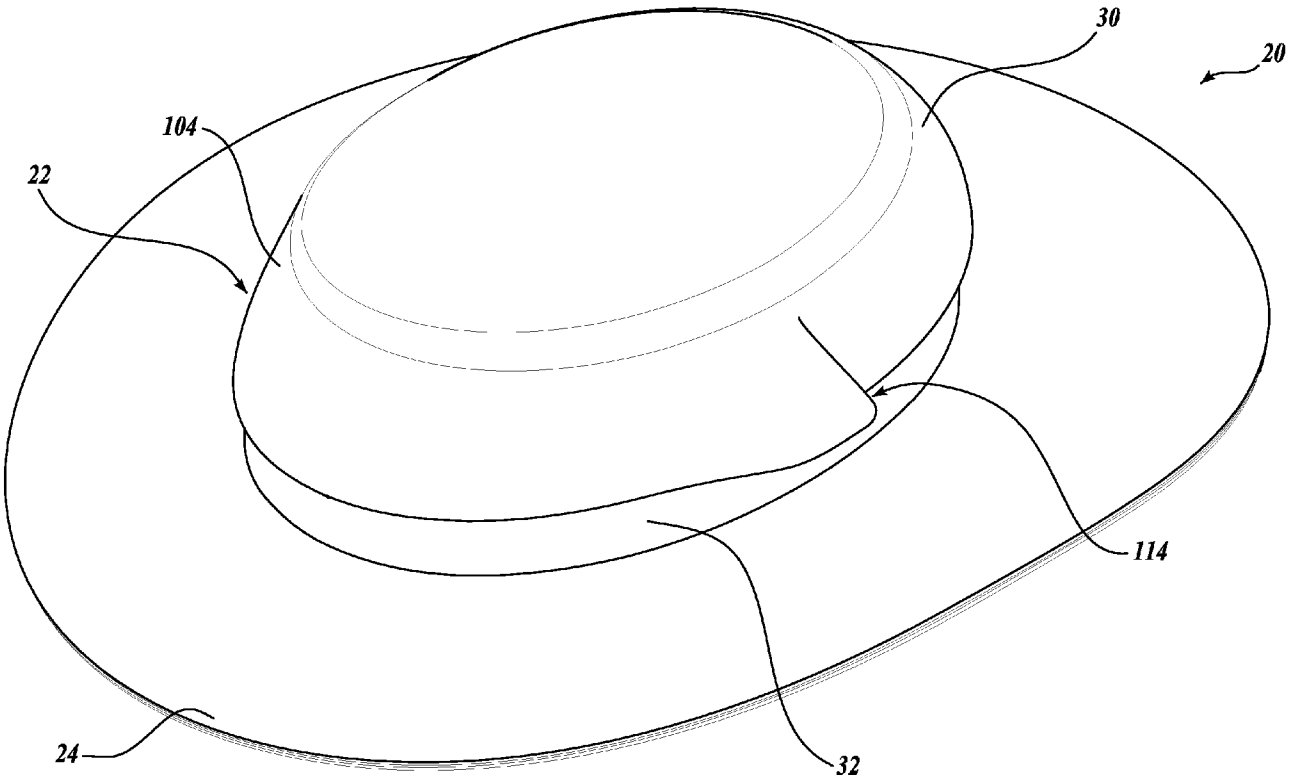
FIG. 1 is a perspective view of one example of a head covering, such as a hat, constructed in accordance with aspects of the present disclosure.
Figure 2:
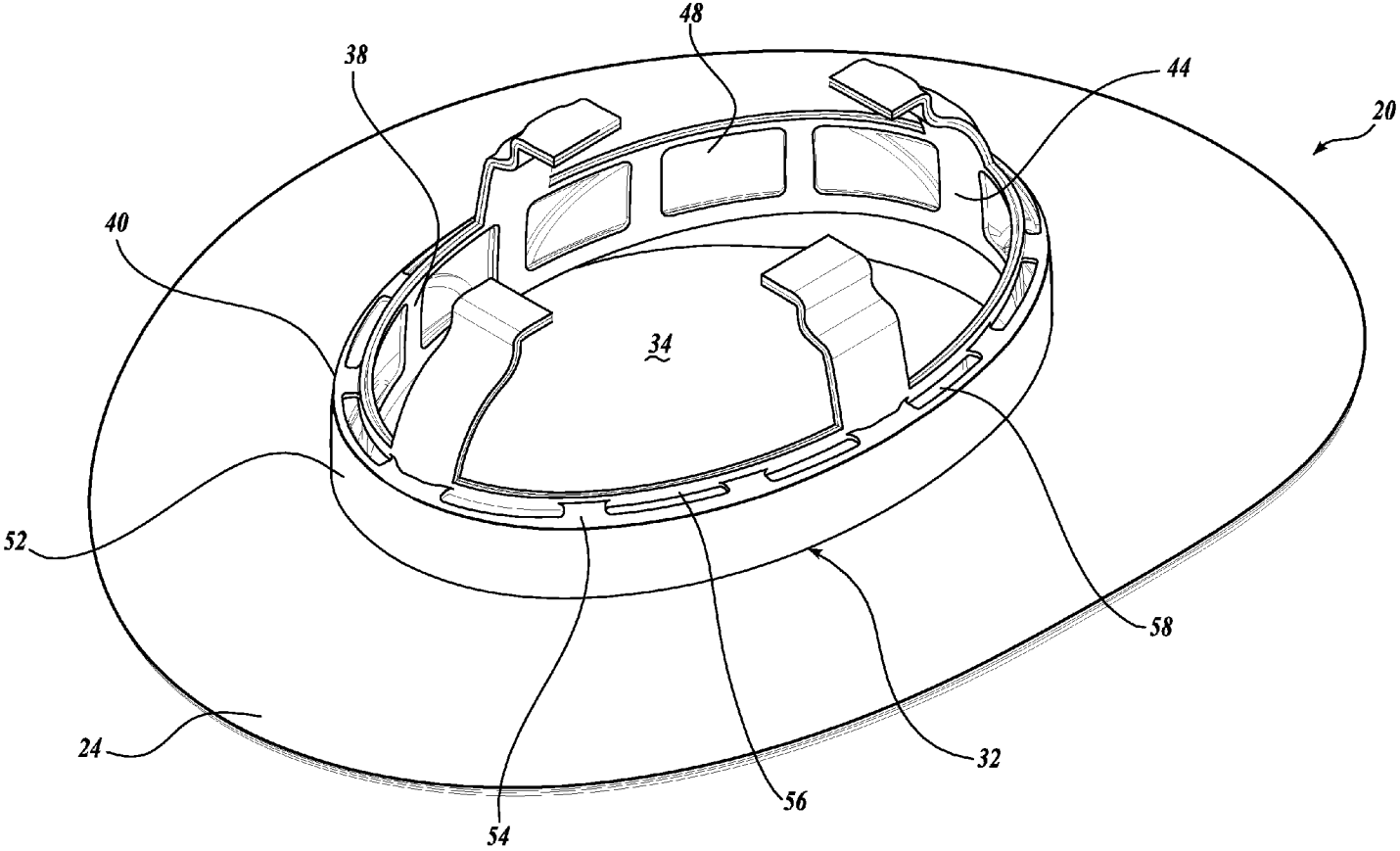
FIG. 2 is a partially perspective view of the hat of FIG. 1 with the upper crown portion removed.
Figure 3:
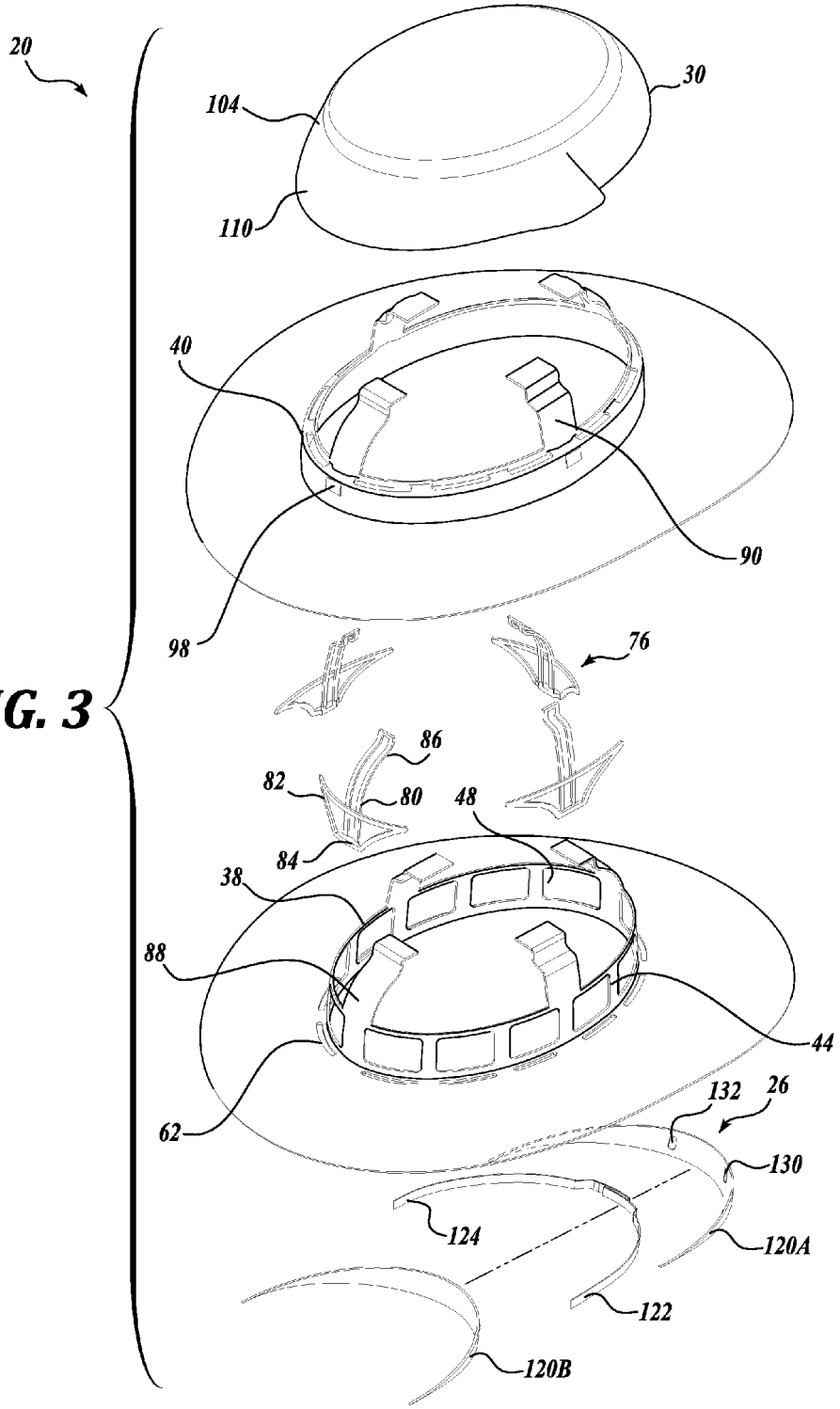
FIG. 3 is an exploded perspective view of the hat of FIG. 1.

FIGS. 1-3 illustrate one representative embodiment of a head covering, generally designated 20, formed in accordance with aspects of the present disclosure. As shown in FIGS. 1-3, the head covering 20 is in the form of a hat (hereinafter "hat 20"), which includes a crown 22 and a brim 24. As will be described in more detail below, the hat 20 may include one or more ventilation features or systems (See FIGS. 4 and 9) that provide suitable air flow into and out of the hat 20, thereby effecting cooling to the user of the hat 20. Additionally or alternatively, the hat 20 may include perspiration removal features (See FIGS. 12 and 16.

Referring to FIGS. 1-3, the crown 22 of the hat 20 is formed with an upper crown portion 30 which extends across the top of the user's head and downwardly along the sides, the front, and the back of the user's head to a lower crown portion 32 which encircles the user's head. Extending outwardly therefrom in all directions is the brim 24, although other configurations where the brim extends outwardly along a portion or portions of the lower crown section 32 are possible. The brim 24 extends in a somewhat horizontal plane, although variations of this are within the scope of the claimed subject matter. In the embodiment shown in FIG. 3, the brim may be formed by a top layer 24A of suitable material and a bottom layer 24B of suitable material.

In embodiments of the present disclosure, the components of the hat may be constructed from any suitable material(s) utilized in the hat making industry. These materials may include, for example, fabrics constructed of natural fibers (e.g., cotton, wool, etc.), synthetic fibers (e.g., nylon, polyester, etc.), coated fibers, impregnated fibers, etc., and combinations, blends, etc., thereof. Some of the fabrics may be occlusive while others may have a degree of translucency or transparency. Other fabrics that may be used include mesh or other permeable membranes. Some may provide water repellency, water resistance, or water proofing.

In one embodiment, the top layer 24A is constructed of a waterproof or water resistant material or membrane, such as rubber, Gore-Tex, etc. In another embodiment, the bottom layer 24B may be constructed of a breathable material, including but not limited to synthetic mesh fabrics. The bottom layer 24B may also be constructed out of a water proof or water repellant material, or the like.

As constructed, the crown 22 and the brim 24 form a hat body that defines an open ended, inner cavity 34 for receiving the user's head. An optional strap 26 (See FIG. 7) extends beneath the hat 20 from either the crown 24 or the brim 26 for retaining the hat on the user's head. The strap 26 may be any presently known or future developed strap capable of retaining the hat 20 on the user's head.

Figure 12:
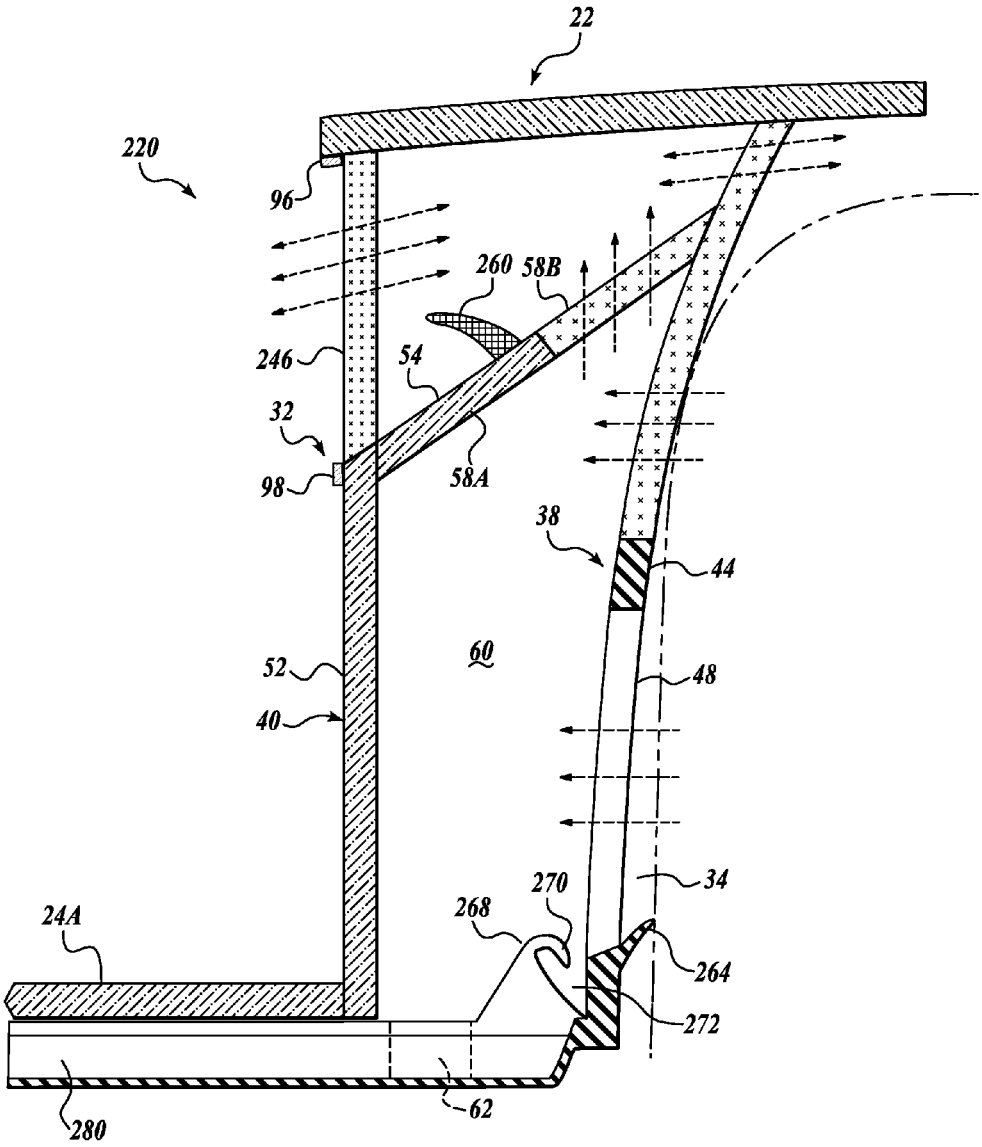
FIG. 12 is a partial cross-sectional schematic view of another embodiment of a hat, wherein the first ventilation system in the "open" position.

Referring now to FIGS. 2-4A, one representative embodiment of a first ventilating system of the hat 20 will now be described in more detail. Generally described, the first ventilation system is configured and arranged to allow air to circulate between the inner cavity 34 and the exterior of the hat 20, thereby providing a cooling effect to the user. As best shown in the embodiment of FIGS. 2-4A, the lower crown portion 32 comprises an inner band 38 and an outer band 40. The inner band 38 includes an upwardly extended sidewall 44 that defines the perimeter of the opening to the inner cavity 34. The sidewall 44 includes a plurality of apertures 48 spaced apart as the inner band 38 extends about the inner cavity. The apertures 48 are somewhat oversized to allow large quantities of air to transfer through the inner band side wall 44. In an alternative embodiment, the inner band 38 may include or be constructed out of mesh or the apertures can be filled with mesh or other material that provides air flow through the inner band 38. In other embodiments, the inner band 38 can extend to the top of the hat 20 as side wall 44B, and can include one or more sections of mesh or other permeable material as it extends from the brim to the upper crown, as best shown in FIG. 12.

In use, one embodiment of the inner band 38 is positioned in relation to the remaining portions of the hat 20 so as to be in intermittent contact with the user's head. In some embodiments, it may be desired to reduce the side wall contact area as much as possible in order to reduce the heat effects on the user's head.

Figure 4A:
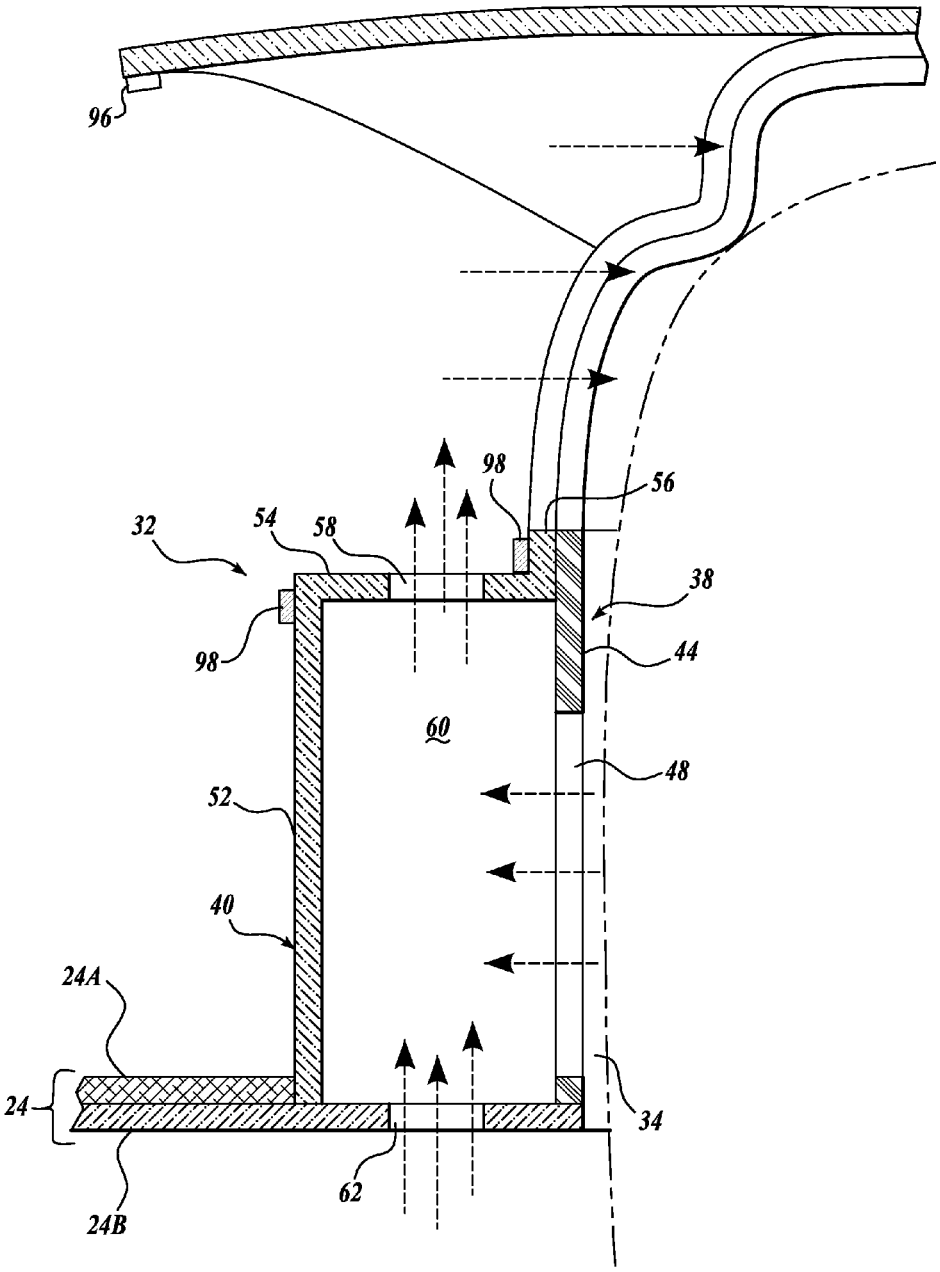
FIG. 4A is a partial cross-sectional schematic view of the hat of FIG. 1, wherein the first ventilation system in the "open" position.

The outer band 40 is spaced outwardly from and encircles the inner band 38. The outer band 40 comprises a sidewall 52 that extends upwardly from the top layer 24A of brim 24, and a rim 54 that extends inwardly from the upper edge of the sidewall 52 to the inner band 38. In the embodiment shown, the sidewall 52 extends approximately vertically from the top layer and is somewhat planar in shape, although other orientations, such as transverse, or shapes, such as arcuate, may be employed. In one embodiment, the rim 54 is secured to the top portion or edge of the inner band 38 via stitching, adhesive, or other known fastening techniques. In other embodiments, the rim 54 can extend upwardly at an angle to the sidewall 52 as it extends to meet to inner band. In the embodiment shown, an inner lip 56 or the like is used for aiding in the securement of the rim 54 to the inner band 38. The outer band 40 is preferably solid along its sidewall 52 and is formed with spaced apart apertures or slots 58 in the rim 54 as the rim extends around the lower crown portion 32. In one embodiment, the slots 58 or apertures may be formed from a mesh fabric or other material that provides air flow through the outer band 38. At the lower end or edge of the sidewall 52, a portion of the brim, such as bottom layer 24B, extends to the lower edge of the inner band 38, as best shown in FIGS. 3 and 4A. In one embodiment, the bottom layer 24B of the brim 24 is secured to the lower edge of the inner band 38 via stitching, adhesive, or other known fastening techniques.

As such, the inner band 38, the outer band 40, and the inner portion of the brim 24 define a ventilation chamber 60 (See FIG. 4A) disposed in fluid communication with the apertures 48 of the inner band 38 and the slots 58 of the rim 54 for allowing air to pass between the inner cavity 34, the ventilation chamber 60, and the exterior of the hat 20. This forms one embodiment of the first ventilation system. It will be appreciated that multiple chambers may be formed around the lower crown portion by dividing the ventilation chamber via cross members, if desired. Therefore, embodiments of the first ventilation system may include a single ventilation chamber that extends around the entire lower crown portion or portions thereof, or may include one or more ventilation chambers that extend around a portion or portions of the lower crown portion 32 of the hat 20.

As shown in FIGS. 3, 4A, 4C, and 4D, one embodiment of the brim 24 further includes apertures or slots 62 disposed in the bottom layer 24B of the brim 24 between the inner and outer bands 38 and 40. In one embodiment, the apertures or slots 62 can be formed by mesh fabric or other material that provides air flow through the brim 24. The slots 62 may be positioned so as to be in approximate vertical alignment with the apertures or slots 58 of the rim 54. As such, the apertures or slots 62, in conjunction with the corresponding apertures or slots 58 of the rim 54 and the apertures 48 of the inner band 38, form another representative embodiment of the first ventilation system. While a portion of the brim 24 (shown as a portion of bottom layer 24B) is described as extending from the lower edge of the outer band 40 to the inner band 38, thereby delineating the lower crown portion in conjunction with the outer and inner bands, this portion of the brim for purposes of understanding one or more of the appended claims may be in some instances considered part of the lower crown portion.

In use, convection forces cause warm air to transfer from the inner cavity 34 to the ventilation chamber 60 via the apertures 48. This air transfer warms the air in the ventilation chamber 60, which in turn, rises and exits through the upper apertures or slots 58. This upward movement of air pulls colder air from below the brim up through the optional apertures or slots 62 of the brim 24 and/or the space between the head of the user and the inner band 38, thereby creating an exemplary air cooling ventilation pattern, as shown by the arrows in FIG. 4A. It will be appreciated that conductive heat transfer may also occur between the user and portions of the hat, such as the inner band 38. Such conductive heat transfer, in turn, may transfer from the inner band 38 to the air in ventilation chamber 60.

Figure 4B:
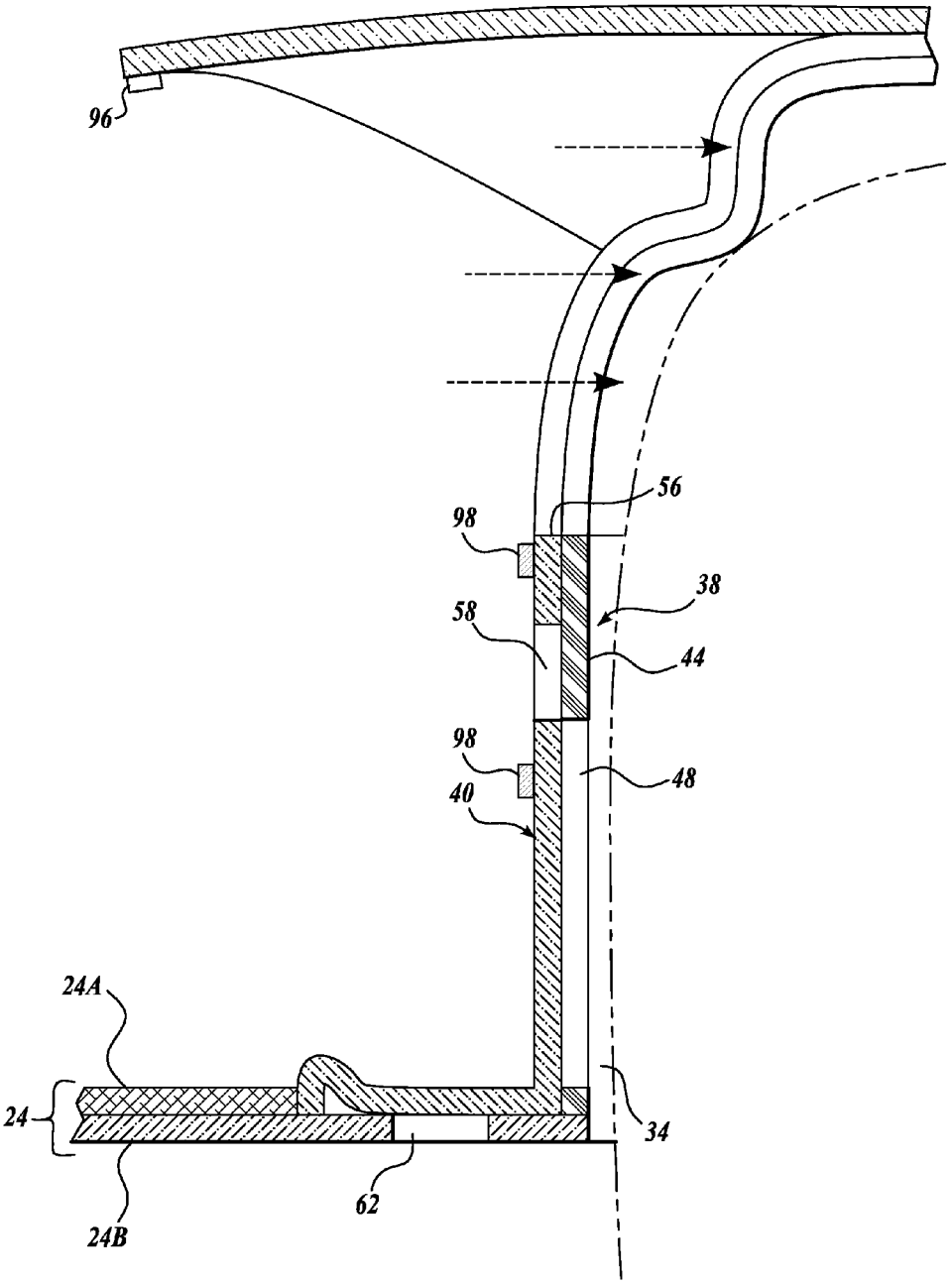
FIG. 4B is a partial cross-sectional schematic view of the hat of FIG. 1, wherein the first ventilation system in the "closed" position.
Figure 4C:
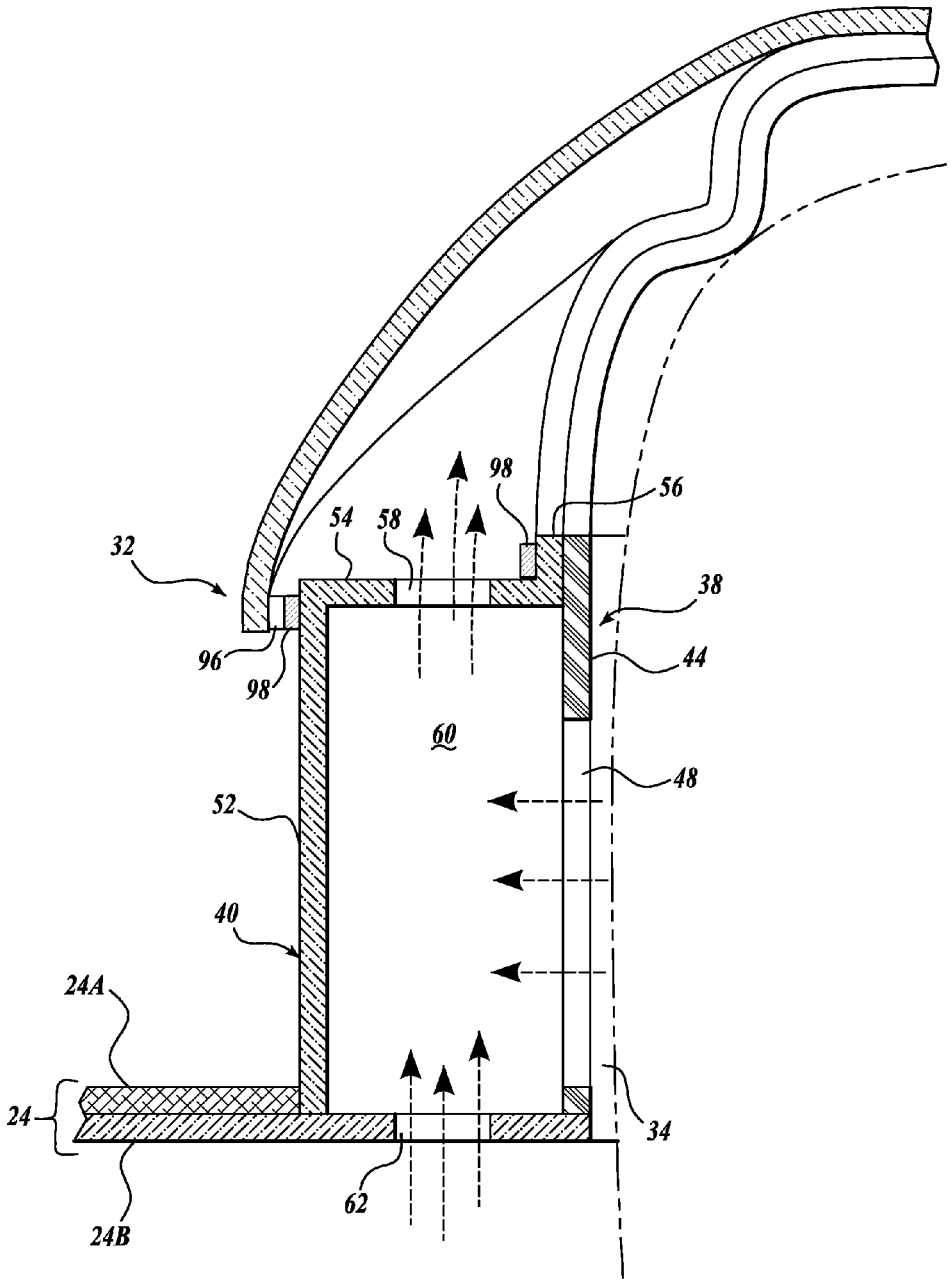
FIG. 4C a partial cross-sectional schematic view of the hat of FIG. 1 in a first closed position.
Figure 4D:
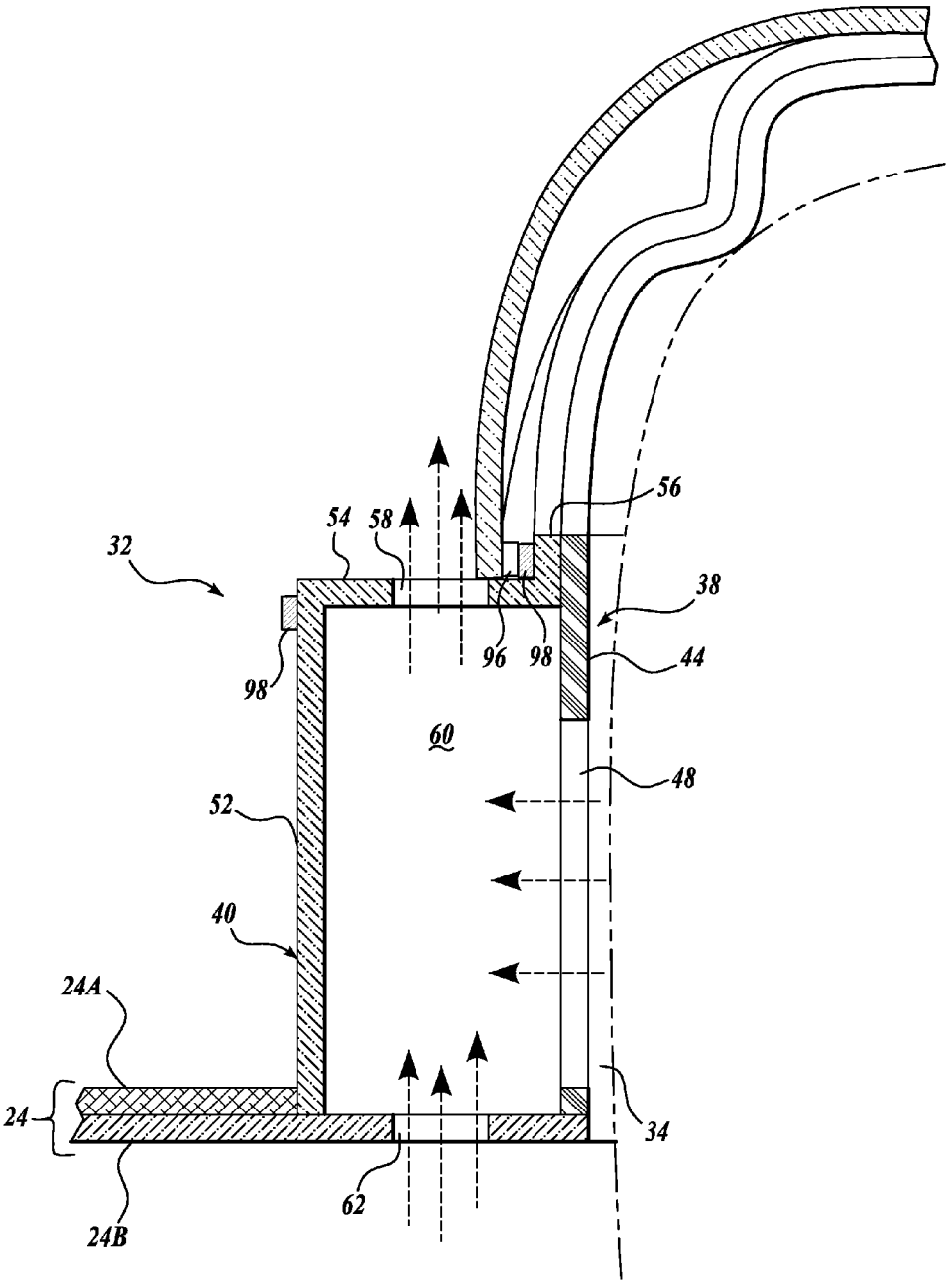
FIG. 4D a partial cross-sectional schematic view of the hat of FIG. 1 in a second closed position.
Figure 4E:
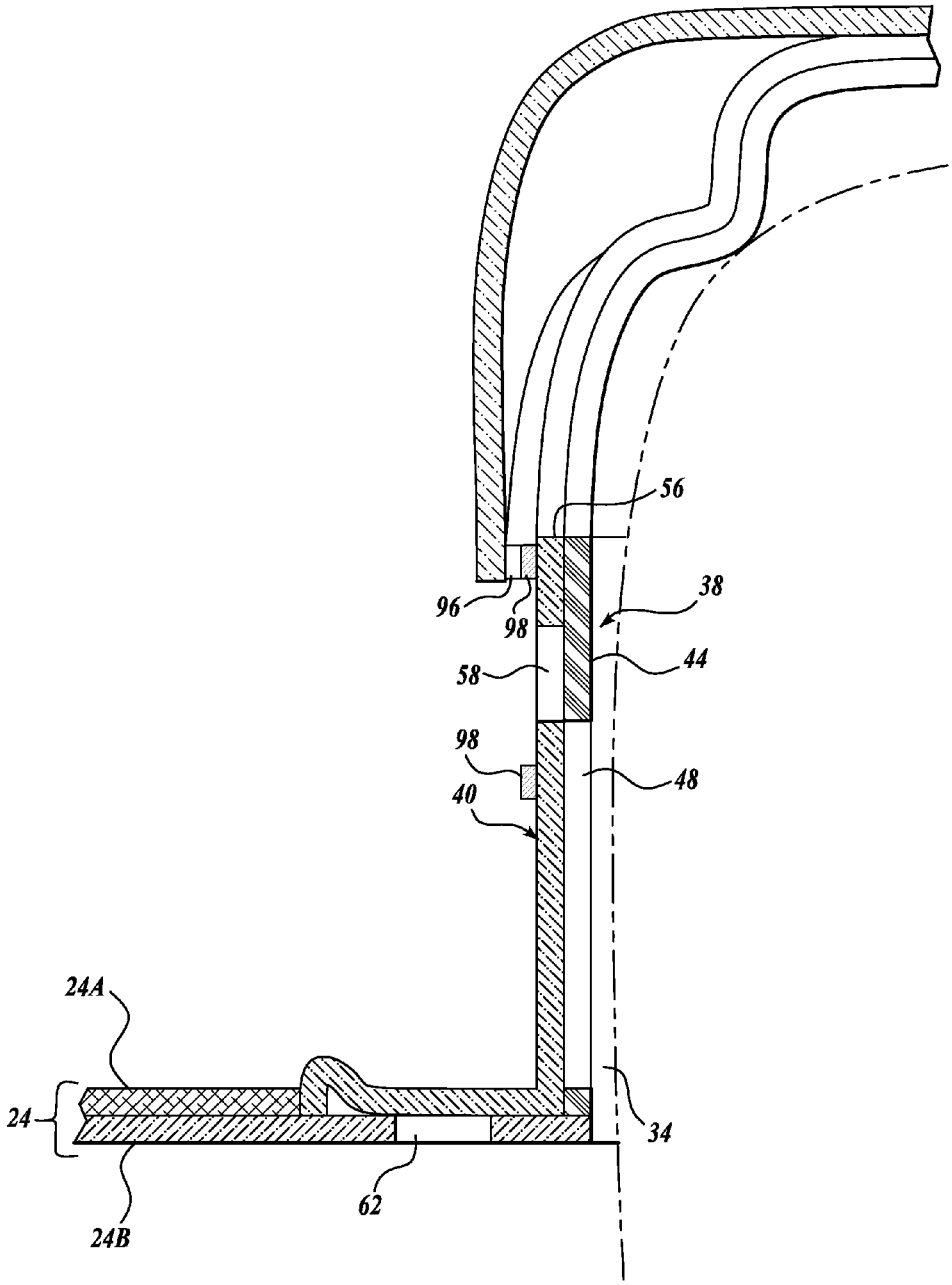
FIG. 4E a partial cross-sectional schematic view of the hat of FIG. 1 in a third closed position.

In one embodiment, the outer band 40 may be constructed out of suitable material so that the outer band 40 may collapse inwardly onto the inner band 38 as shown in FIGS. 4B and 4E. In this position, ventilation through the apertures 48 and slots 58 is blocked. In this position, ventilation may still occur as indicated by the arrows in FIG. 4B via the opening formed between the top of the lower crown portion 32 and the bottom of upper crown portion (also referred to as a second ventilation system), as will be described in more detail below.

Figure 11:
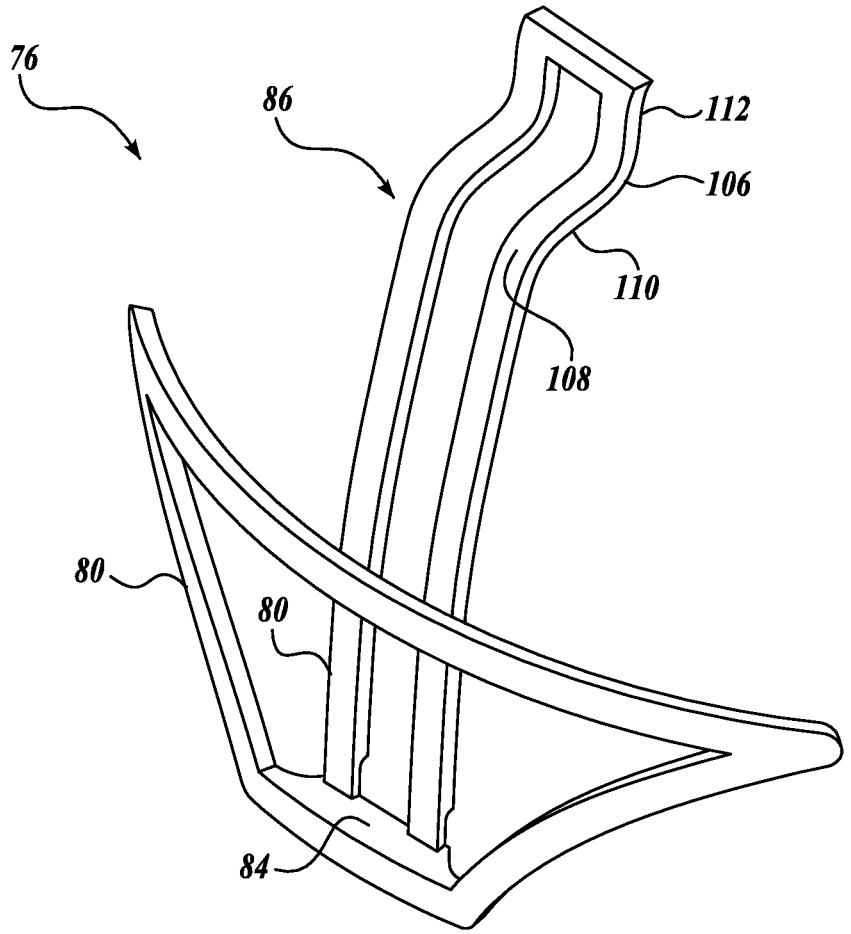
FIG. 11 is perspective view of one embodiment of a support/spacer formed in accordance with aspects of the present disclosure.

The lower crown portion 32 and the brim 24 may be configured and/or constructed of suitable materials to provide sufficient rigidity for forming and maintaining the one or more ventilation chambers 60, and for providing the overall shape of the hat 20. It will be appreciated that any known means for enhancing rigidity or reinforcing portions of the lower crown portion 32 and the brim 24 may be practiced with embodiments of the present disclosure. Additionally or alternatively, the hat 20 may include support/spacers 76 for adding rigidity to portions of the hat and/or defining the ventilation chamber(s). In one embodiment shown in FIGS. 3 and 11, the support/spacers 76 comprise an inner leg section 80, an outer leg section 82, and a cross member 84 integrally connected between the lower ends of the inner and outer leg sections. The support/spacers 76 may be constructed out of any suitable lightweight and durable plastic or like material. When assembled in the hat, the support/spacers 76 may be fixed in place via stitching, adhesive, etc., whereby the inner leg section 80 supports the inner band 38, the outer leg section 82 supports the outer band 40, and the cross member 84 helps define the geometry of the ventilation chamber(s) 60.

Figure 8:
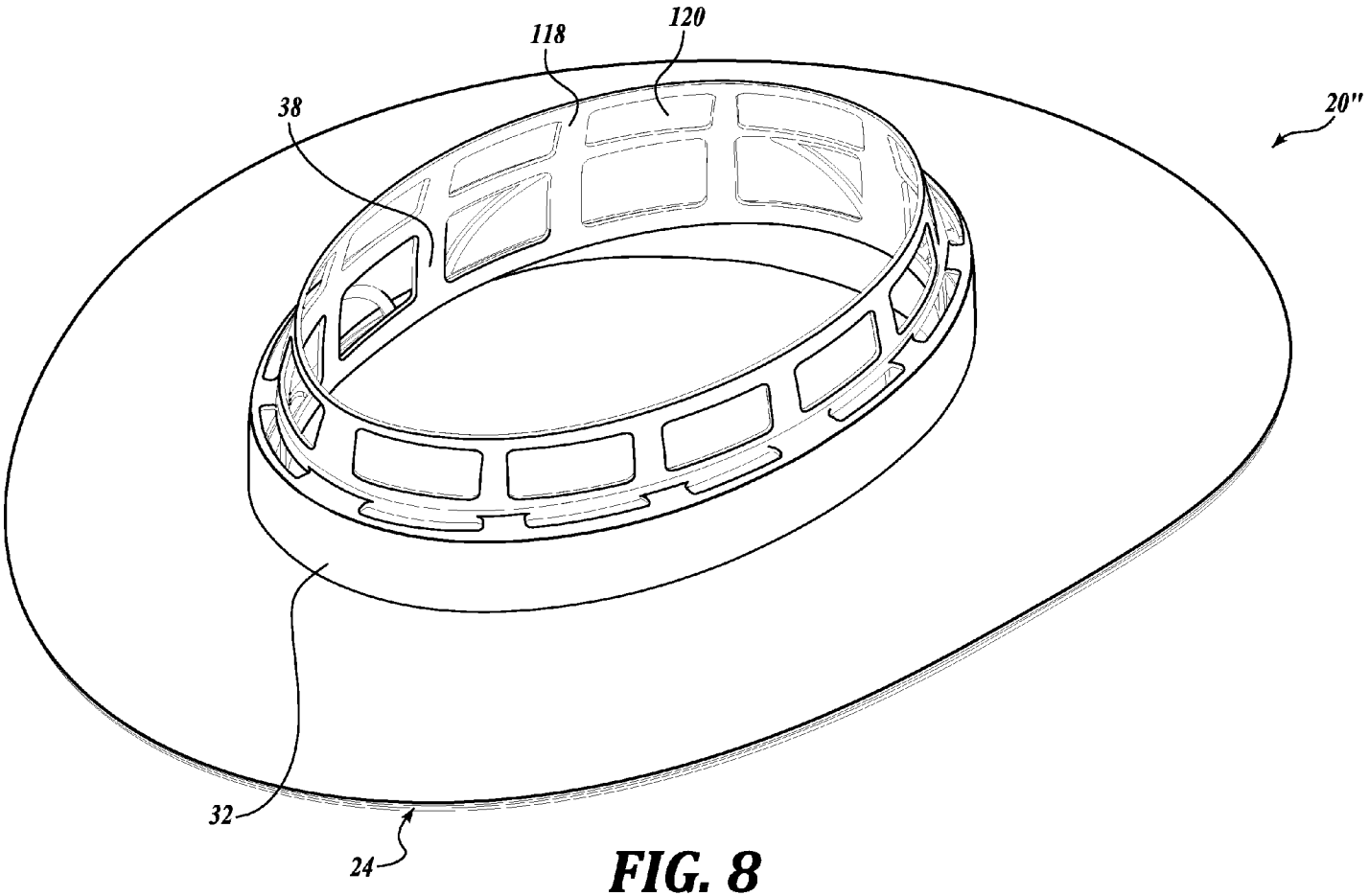
FIG. 8 is a perspective view of yet another embodiment of a hat constructed in accordance with aspects of the present disclosure, wherein the upper crown portion has been removed.
Figure 9:
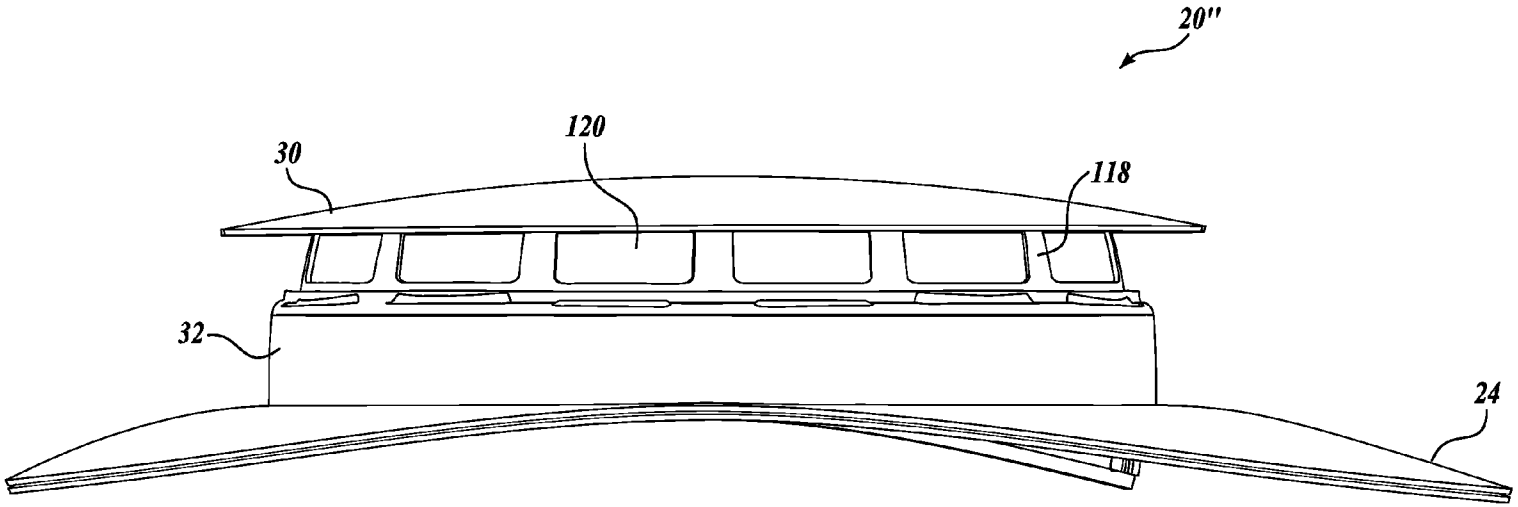
FIG. 9 is a side view of the hat depicted in FIG. 8, with the upper crown portion selectively attached and disposed in a ventilation position.

In one embodiment, an upper portion 86 of the inner leg section 80 of the support/spacers 76 may extend upwardly past the lower crown section 32 to provide support to the upper crown portion 30. In these embodiments, the top of the upper portion 86 of inner leg sections 80 support the upper crown portion 30 while the sides of the support/spacers 76 support the sides of the upper crown portion 30. In the embodiment shown, the inner leg sections 80 are jacketed by suitable materials, including an inner jacket portion 88 and an outer jacket portion 90, which may be integrally formed as part of the inner band 38 and the outer band 40, respectively. These layers may be designed to augment the support of the supports/spacers. Alternatively, these layers may support the upper crown portion in lieu of the upper portion 86 of the support/spacers 76. For example, in an alternative embodiment shown in FIGS. 8 and 9, the support/spacers 76 omit the upper portion 86 and the inner band 38 extends upwardly past the top of the outer band 40 as upper inner band portion 118. In these embodiments, the inner band 38 can be configured with sufficient rigidity for supporting the upper crown portion of the hat 20. It will be appreciated that the support/spacers 76 can be omitted in this embodiment. As shown in FIGS. 8 and 9, the upper inner band portion 118 may include apertures 120 to promote ventilation between the user and the environment, as will be described in more detail below.

In one embodiment, the top of the spacer jacket is secured to the top region 104 of the upper crown portion 30. To provide additional cooling to the user, the upper portion 86 of the support/spacers 76 may be configured to support the top region of the upper crown portion 30 a spaced distance above the top of the user's head (See FIGS. 4A and 4B). In one embodiment, the upper portion 86 of the support/spacers 76 are formed with first and second elbows 106 and 108 (See FIG. 11), a lower, somewhat horizontal portion 110 for providing a contact region that interfaces with the head of the user, and an upper, somewhat vertical portion 112 that supports the upper crown portion 30 a spaced distance from the top of the user's head. The support/spacers 76 may also be configured with third and fourth elbows (not shown) positioned below and outwardly of the first and second elbows in order to provide lateral space between the user's head and the support/spacer to lessen the effects of conductive heat transfer and to promote additional airflow through the hat, over the user's head, etc.

In accordance with other aspects of the present disclosure, the crown 22 may be configured to provide additional ventilation capabilities to the hat. In some embodiments, the upper crown portion can include holes, grommets, mesh, etc., along sections thereof (e.g., left and right sides of the hat). In other embodiments, the upper crown portion 30 may be a discrete component apart from the lower crown portion 32, as best shown in FIGS. 3, 4A-4B, and 9. When assembled, the top region 104 of the upper crown portion 30 is secured to the remainder of the hat 20. For example, the top region 104 of the upper crown portion 30 may be either mounted onto the top portions of the jacketed support/spacers 76 or onto the top of upper inner band portion 118, as shown, for example, in FIG. 9. In one embodiment, the lower perimeter region 110 of the upper crown portion 30 extends downwardly along the sides, the front, and the back of the user's head and may be configured to selectively attach to the lower crown portion 32 via one or more suitable fasteners. For example, hook and loop fastener components 96 and 98 (See FIGS. 4A and 4B) may be employed, although other cooperatingly configured fasteners may be used, such as snaps, buttons, zippers, etc. Alternatively, other fasteners may be used that are primarily mounted to one of the two components while selectively attaching to the other of the two components, such as clips, clamps, etc. In other embodiments, the lower crown portion 32 may be held in contact or close proximity to the lower crown portion 32 with the use of, for example, pull strings, etc.

When the lower perimeter region 110 is selectively attached to the lower crown portion 32, the lower edge thereof either overlaps or abuts the inner crown portion 32, as shown in FIGS. 4C and 4D, respectively, forming first and second closed positions, thereby protecting the user from the elements. In some embodiments, to tightly surround the lower crown portion 32, excess material on both sides of the upper crown portion may be folded over and secured to itself, as shown as reference numeral 114 in FIG. 1, using any suitable fastening techniques, such as snaps, buttons, hoop and loop fasteners, etc.

To provide additional ventilation capabilities to the hat 20, one or more sections of the lower perimeter region 110 may be detached, removed from close proximity, etc., from the lower crown portion 32, and in one embodiment, be folded upwardly in an outward manner, thereby exposing the inner cavity 34 to the exterior of the hat 20. This forms one or more ventilation positions of the upper crown portion 30 of the hat 20. To keep these sections folded upwardly, the outside of the upper crown portion 30 and/or the lower perimeter region may include suitable fasteners, e.g., snaps, buttons, hook and loop fasteners, to selectively fasten the lower perimeter region 110 to the top region 104 of the upper crown portion 30.

Figure 5:
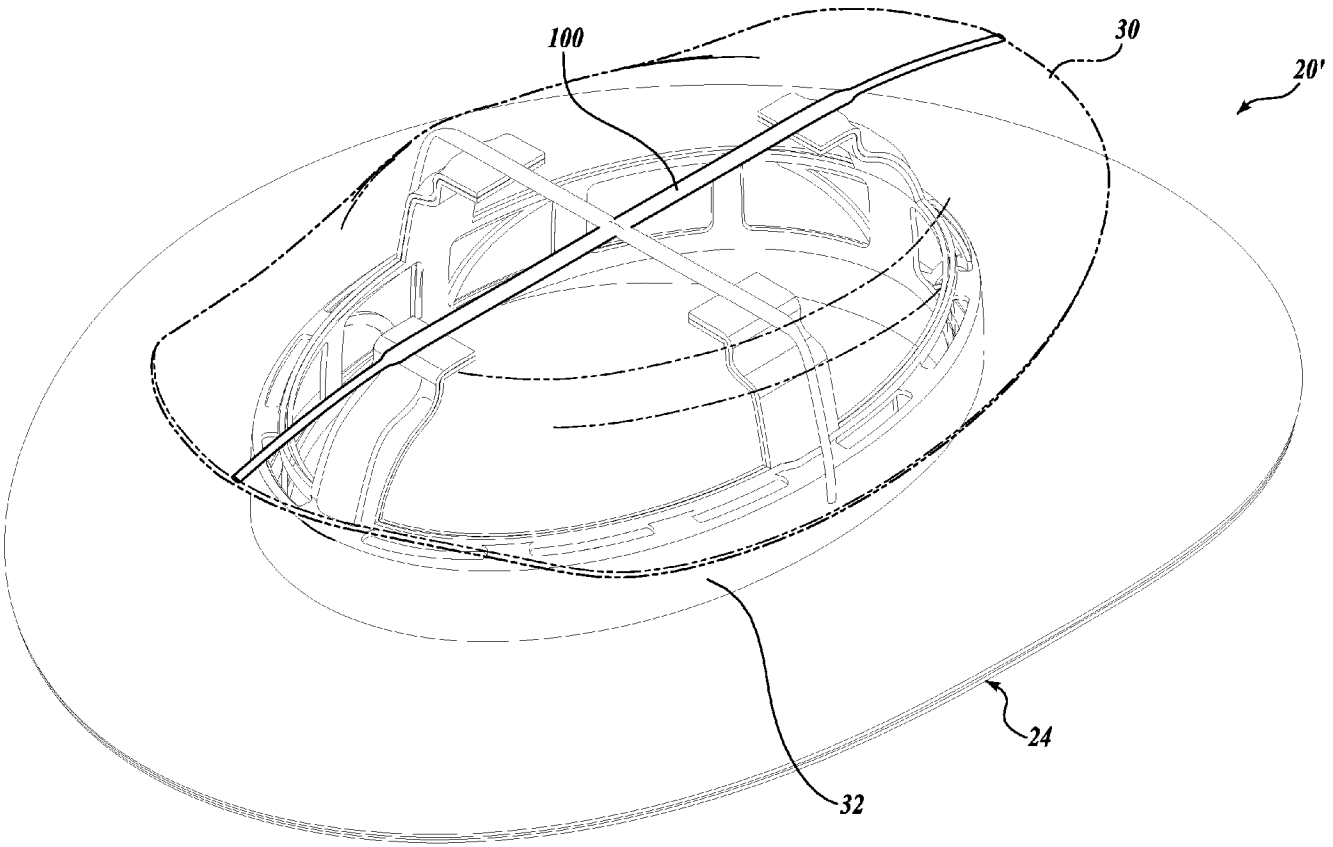
FIG. 5 is a perspective view of another embodiment of a hat with the upper crown portion in phantom to illustrate features thereof, wherein the upper crown portion is selectively attached to the lower crown portion at the sides of the hat.
Figure 6:
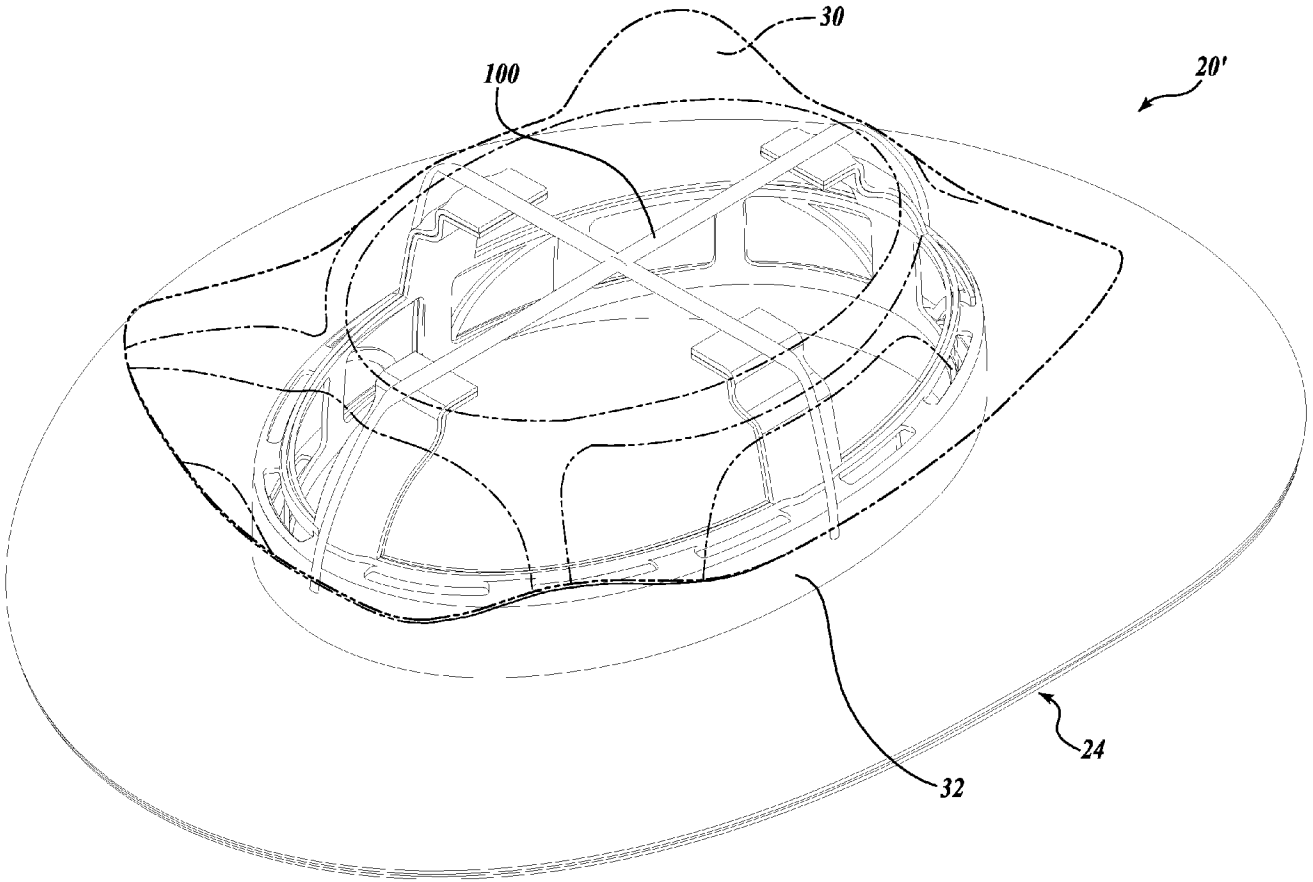
FIG. 6 is a perspective view of the hat of FIG. 5, wherein the upper crown portion is selectively attached to the lower crown portion at the front, back, and sides of the hat.

The upper crown portion 30 may include additional support structure or configured with increased rigidity, if desired, to support the upper crown portion 30 and to provide some shape thereto. For example, in one embodiment, as best shown in FIGS. 5 and 6, one or more cross members 100 may be included. The cross members 100 may be either embedded into the upper crown portion 30 or may be affixed to the inner surface thereof. In the embodiment shown, two perpendicularly disposed cross members 100 are utilized, although additional cross members may be used. Alternatively, the upper crown portion 30 may include an internal air bladder that is selectively inflated/deflated to provide sufficient rigidity and/or provide the desired shape of the upper crown portion 30.

In several embodiments, either through the use of the internal air bladder, the cross members 100, and/or other rigidity enhancements to the upper crown portion 30, the upper crown portion 30 can be configured to be in a somewhat flat configuration (See FIG. 9) in its normal state, although other configurations of the upper crown portion are possible. In some embodiments, the cross members 100 may be constructed of suitable plastic or metallic material that is bendable, but has sufficient rigidity to return to its unbent state. To form one of the closed positions in use, the lower perimeter region 110 of the upper crown portion 30 is deflected downwardly toward the lower crown portion 32, thereby producing bias forces therein. The lower perimeter region 110 can be selectively attached to the lower crown portion 32 via one or more suitable fasteners.

In the embodiment shown in FIGS. 4A, 5 and 6, a portion 96 of the fastener may be secured to the bottom surface of the upper crown portion, with the cooperating fastener portion 98 being secured to the lower crown portion 32. To form one or more ventilation positions in use, one or more portions, for example, the front and back of the upper crown portion 30, are detached from the lower crown portion 32. Due to the biasing forces, for example, in the deflected cross members 100, the front and back portions of the upper crown portion 30 return to its normal position, as best shown in FIG. 5. In this position, the upper crown portion can protect the user from the elements while also allowing air from wind, movement of the user, etc., into the inner cavity and over the head of the user (See FIGS. 4A and 4B), thereby providing a cooling effect to the user.

While several ventilation features are provided by the lower crown portion and/or the upper crown portion, as shown in the examples above, it will be appreciated that air may enter and exit the hat in other areas or by other means. For example, air may enter/exit at locations around the inner band 38 at the interface between the inner band 38 and the head of the user. Moreover, the material or fabric used to construct portions of the hat, such as the upper crown portion, lower crown portion, brim, etc., may include areas that are "breathable" or otherwise permit air flow through the material or fabric and into/out of the inner cavity 34. In some other examples, the upper crown portion, lower crown portion, brim, etc. may include holes, grommets, etc., for permitting air flow into/out of the inner cavity 34

Figure 7:
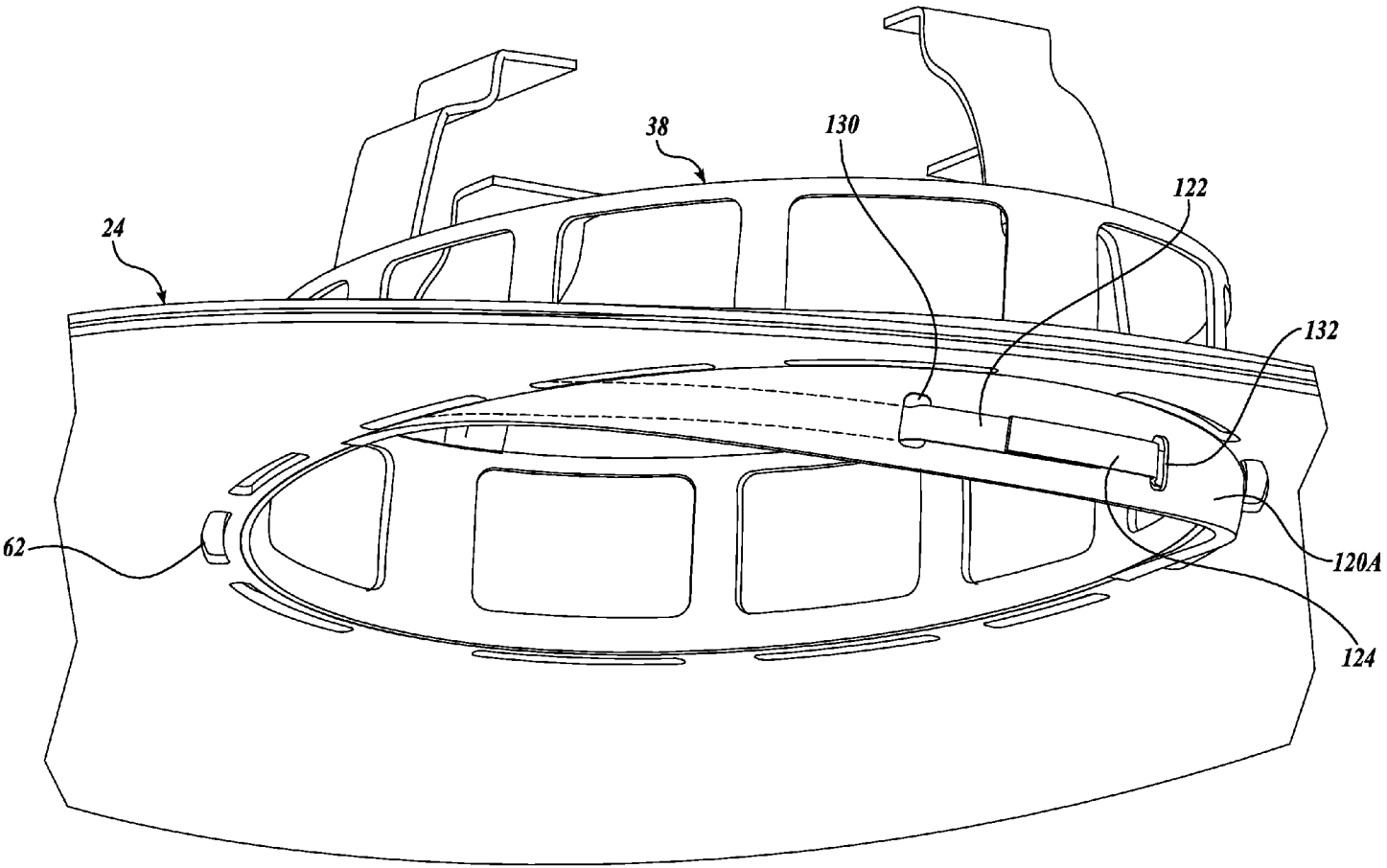
FIG. 7 is a bottom rear perspective view of the hat of FIG. 2, depicting one embodiment of a strap formed in accordance with aspects of the present disclosure.
Figure 10A:
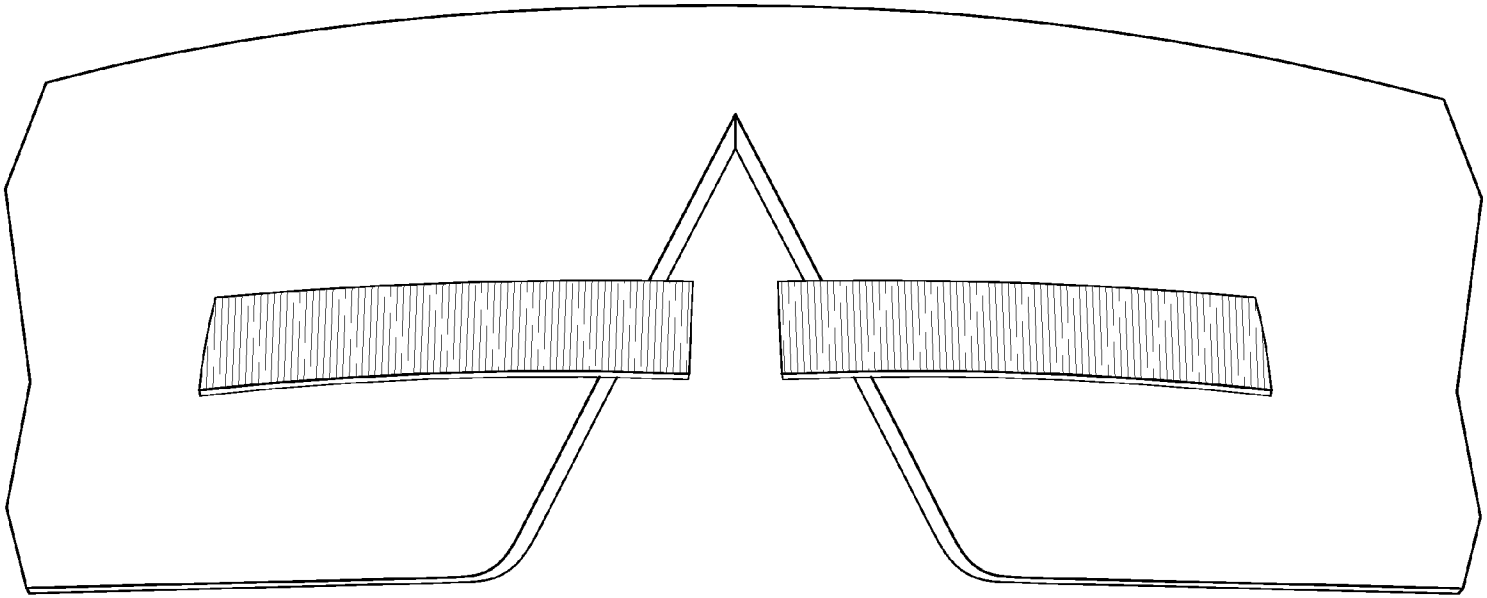
FIGS. 10A and 10B are alternative embodiments of a strap formed in accordance with aspects of the present disclosure.
Figure 10B:
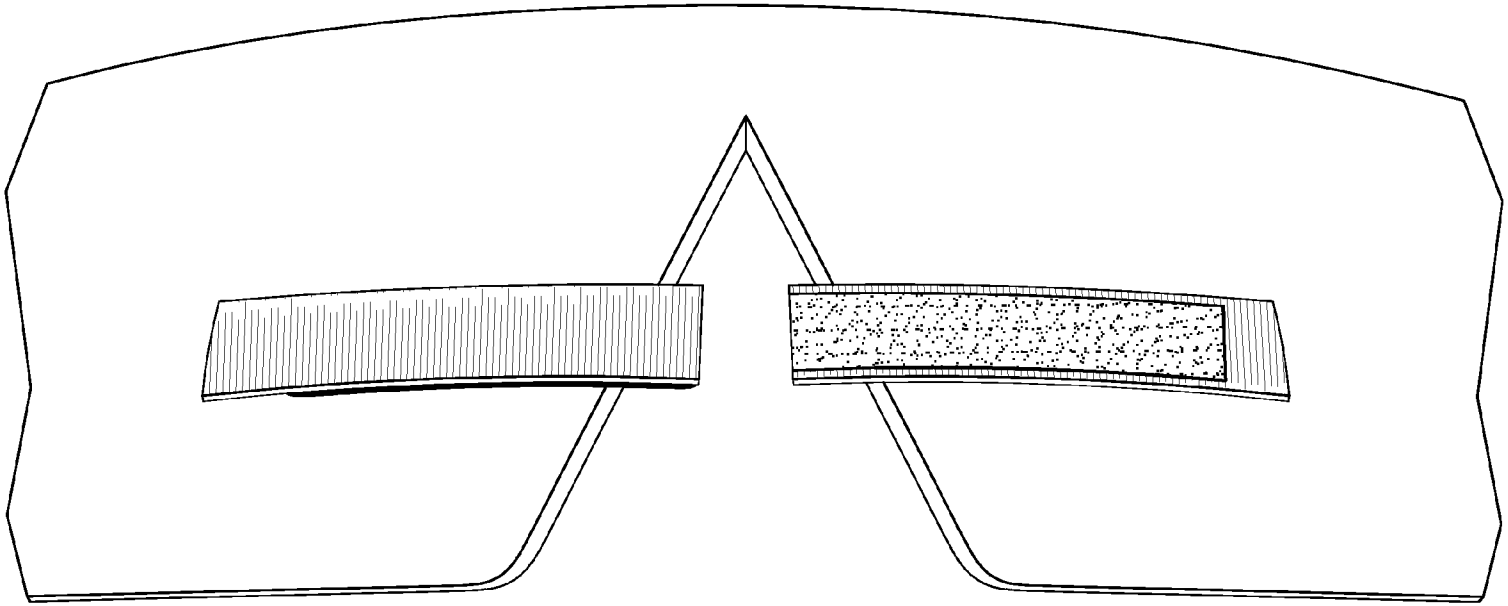

As described briefly above, an optional strap 26 may be provided to help retain the hat 20 on the user's head. One suitable strap that may be practiced in accordance with aspects of the present disclosure is depicted in FIG. 7. FIG. 7 is a bottom, rear perspective view of the hat 20 illustrating the strap 26. In the embodiment shown in FIG. 7 (and in FIG. 3), the strap 26 is comprised of at least one strip 120 of material, shown as back and front strips 120A and 120B that are anchored along the sides of the hat and extend rearwardly and downwardly from the sides of the brim 24, thereby forming a loop having a pocket or channel (not shown) therein. The strap 26 further includes left and right strap sections 122 and 124 discrete from and movable with respect to the strips 120A and 120B. The left and right strap sections are likewise anchored to the sides of the hat 20 and extend along the pocket or channel of the strip 120. The ends of the left and right strap sections 122 and 124 extend through openings 130 and 132, respectively, in the rear of the loop. The ends of the strap sections include adjustable fastening means, such as hook and loop fasteners, buttons, snaps, etc. in order to selectively tighten the strap 26 around the back of the user's head. Alternative embodiments of the strap 26 are illustrated in FIGS. 10A and 10B.

Figure 13:
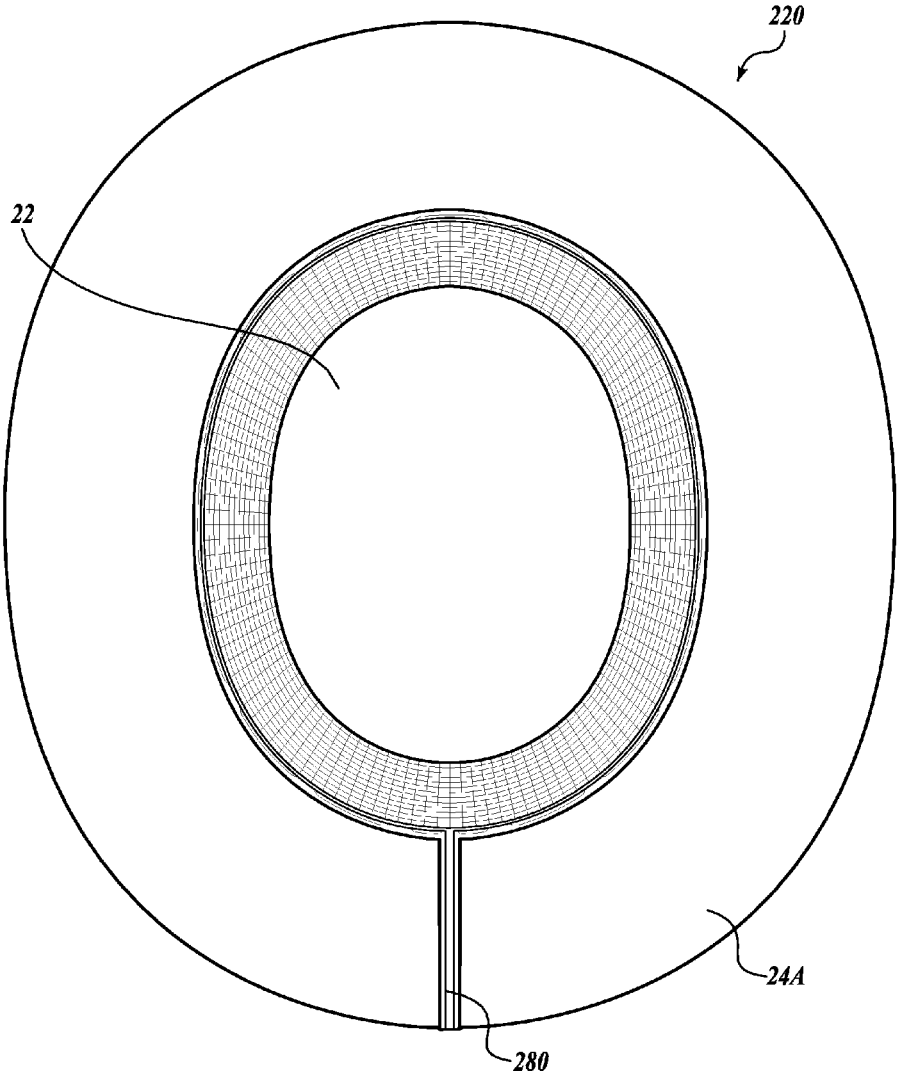
FIG. 13 is a top view of the hat of FIG. 12.

FIGS. 12 and 13 illustrate another embodiment of a head covering, such as hat 220, formed in accordance with aspects of the present disclosure. The hat 220 is substantially similar in construction and operation as the hat 20 except for the differences that will now be described in detail. As shown in FIG. 12, the rim 54 of the outer band extends upwardly in a slanting manner as it extends inwardly to connect with the inner band 38. The rim 54 in other embodiments may extend upwardly in a slanting manner as it extends inwardly to connect with the top of the hat or crown 22. In either case, such configurations may help to prevent water that is shelving off of the top of the hat, from getting into the inner cavity 60. In some embodiments, the side wall 52 is occlusive or otherwise substantially restricts airflow therethrough. In these and other embodiments, the rim 54 is constructed out of an occlusive or substantially occlusive outer section 58A and a mesh or permeable inner section 58B. The inner band 38 in this embodiment can extend upwardly from the inner edge of the brim 24 to the top of the crown 22 as side wall sections 44A and 44B. The inner band 38 can include one or more sections of mesh or permeable material, such as side wall section 44B, although other configurations are possible to allow air flow through the rim 54.

Figure 20:
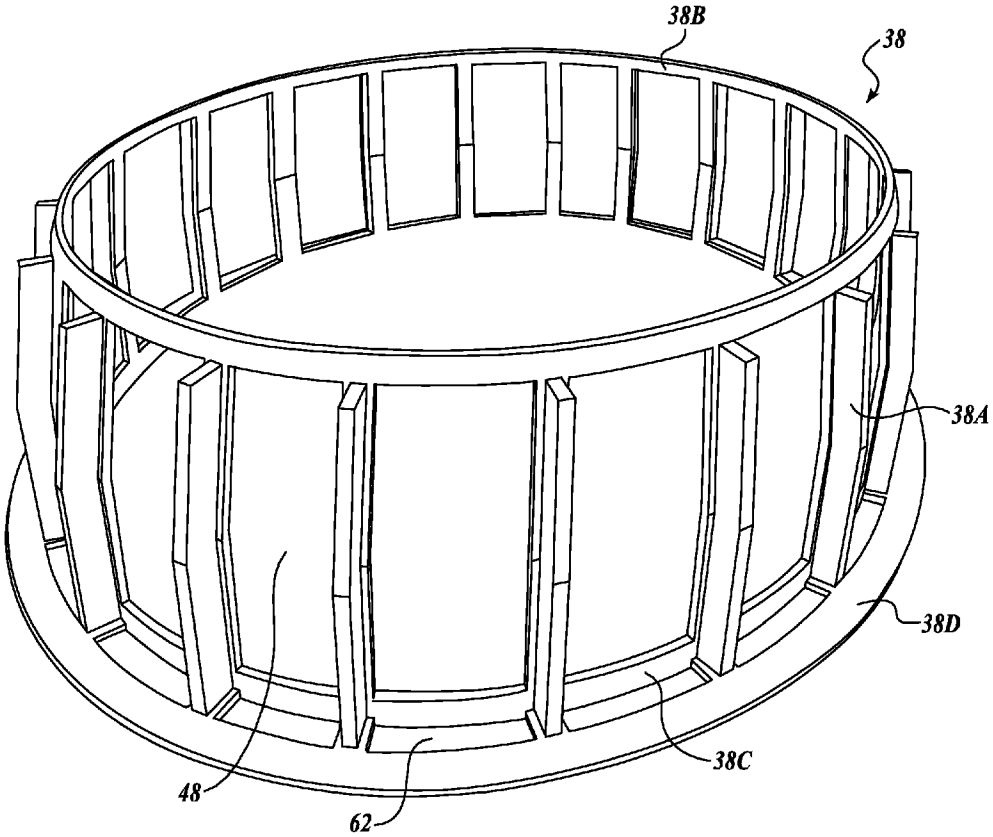
FIG. 20 is a perspective view of another embodiment of an inner band suitable for use in the head coverings of FIGS. 1 and 12, among others.

For example, as shown in FIG. 20, the inner band 38 can be comprised of suitably rigid or semi-rigid frame members 38A that are connected at their upper ends via an upper support ring 38B and are connected at the inner surface of their lower ends via lower support ring 38C. The frame members can be spaced apart, thereby forming apertures 48. A second lower support ring 38D can be provided, which is disposed outwardly of lower support ring 38C. The second lower support ring 38D can be connected to the outer surface of the lower ends of the frame members 38A. As such, the apertures or slots 62 are formed between the first and second lower support rings 38C and 38D.

Similarly, in the embodiment shown, the side wall 52 of the outer band 40 can extend past the junction with the rim 54 and continue to extend upwardly as upper section 246 to meet with the top of the crown 22. Some or all of the upper section may be constructed out of mesh or other permeable material in order to allow cross flow of air through the hat as shown by the arrows proximate the crown 22. In the embodiment shown, the outer edge of the crown 22 extends radially outwardly of the outer edge of the slots or mesh 58B to help prevent water from entering the inner cavity 60.

The hat 220 may also include a gutter 260 or other structure mounted to or otherwise disposed on the rim 54 outwardly of the mesh or permeable inner section 58B, as shown in FIG. 12. The gutter 260 is configured to help further prevent water from entering the chamber 60 or other parts of the hat when, for example, the wearer were to bend over and look down (e.g. while putting on a golf course, etc.).

In accordance with another aspect of the present disclosure, the hat 220 may further include a perspiration removal system comprising a perspiration gutter 268 that emanates from the joint between the inner band 38 or wall and the lower brim 24. The perspiration gutter 268 extends upwardly and outwardly from the inner wall to some degree but not enough to obstruct air from entering through the ventilation chamber openings 62 in the lower brim 24. The top of the gutter 268 includes an inwardly projecting lip 270. Thus, the gutter 268 is configured to help prevent perspiration from coming out of channel 270 if the wearer were to bend over, shake their head, etc.

The hat 220 further includes a "seal" or "skirt" element 264 on the inner band 38 or wall that shelves perspiration over into the channel 272 formed by the perspiration gutter 268 preventing it from draining down in between the inner wall and the wearer's head, and possibly preventing such perspiration from getting into the wearer's eyes. In the embodiment shown, the skirt element 264 is located above the perspiration gutter 268 and extends around the perimeter of the inner band 38 or sections thereof. Likewise, the perspiration gutter 268 extends around the outer perimeter of the inner band 38 or sections thereof. Perspiration or other moisture (e.g., rain, etc.) that is collected in the channel 270 is channeled around to, for example, the back of the hat 20, and is collected in a conduit 280 at the rear of the hat. The conduit 280 extends outwardly from the inner band 38 to the outer edge of the brim 24 to deposit the fluid away from the wearer's head and body, as shown in the FIGS. 12 and 13.

Figure 14:
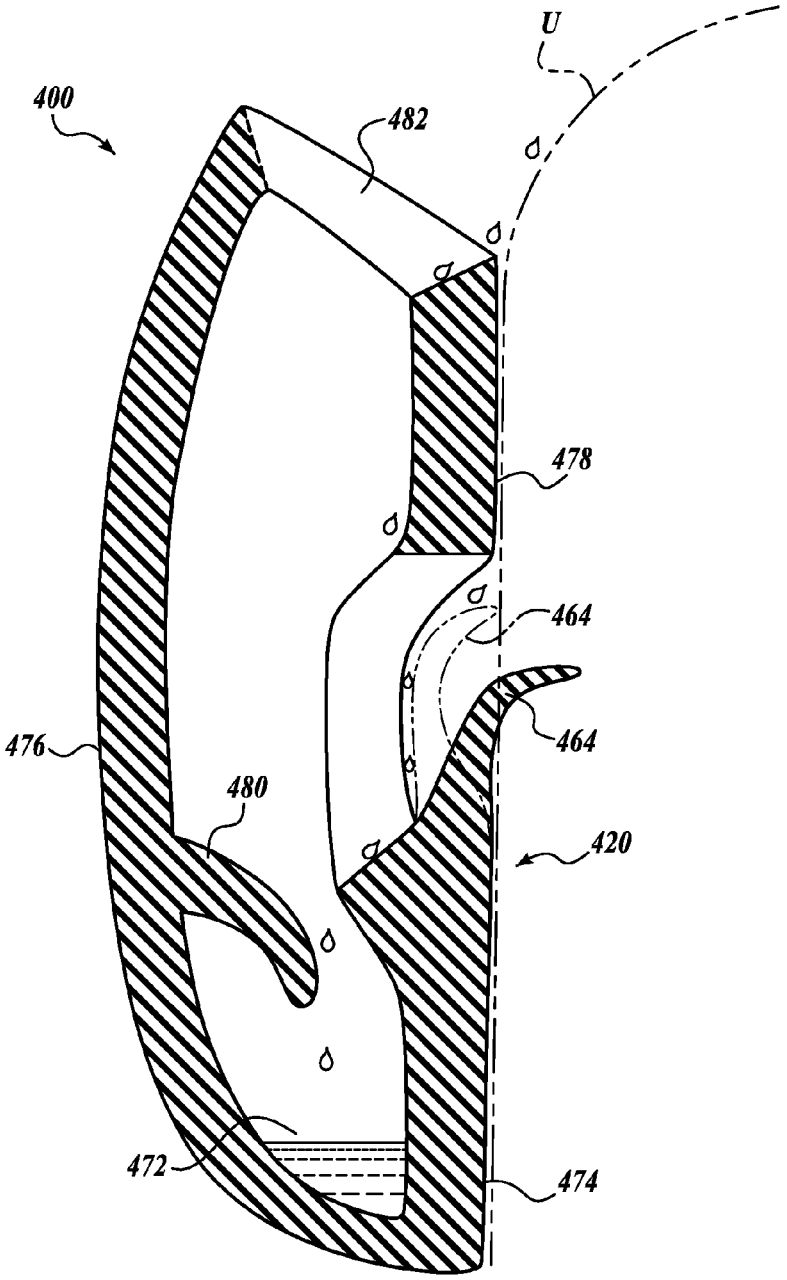
FIG. 14 is one example of a head covering, such as a bandana, depicting a cross sectional view of one embodiment of a perspiration removal system in accordance with aspects of the present disclosure.
Figure 15:
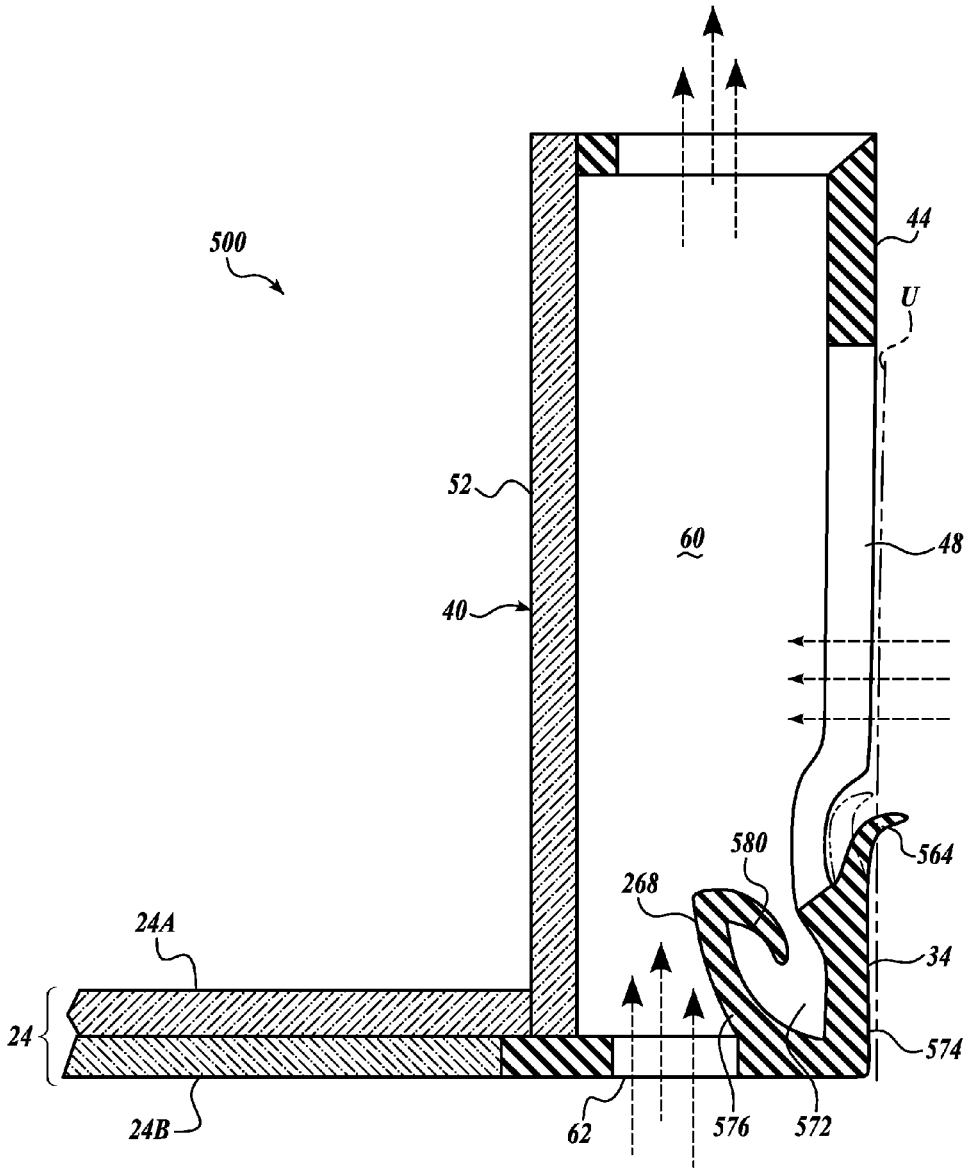
FIG. 15 is one example of a head covering, such as a visor, depicting a cross sectional view of one embodiment of a perspiration removal system in accordance with aspects of the present disclosure.
Figure 16:
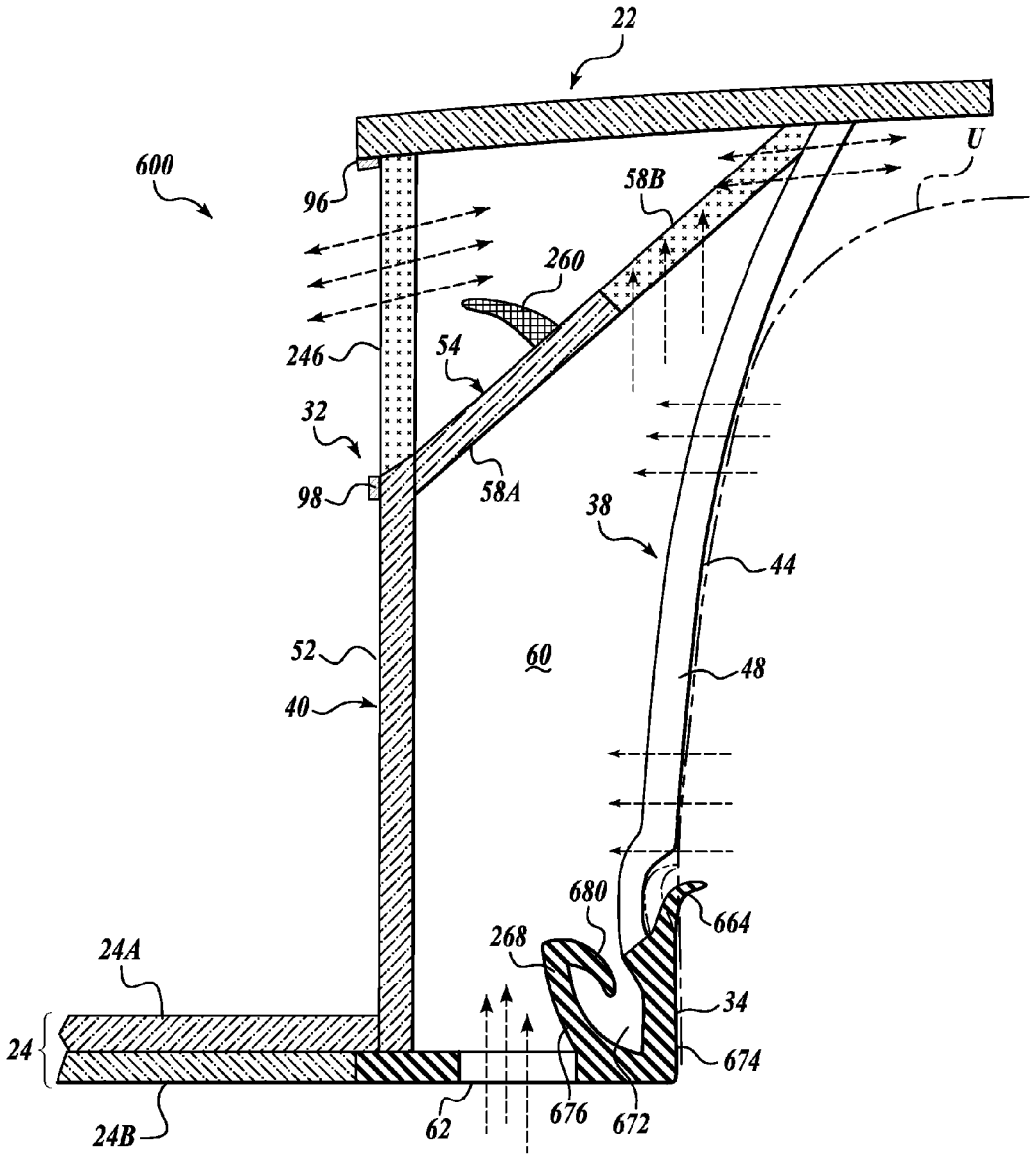
FIG. 16 is one example of a head covering, such as a hat, depicting a cross sectional view of one embodiment of a perspiration removal system in accordance with aspects of the present disclosure.
Figure 17:
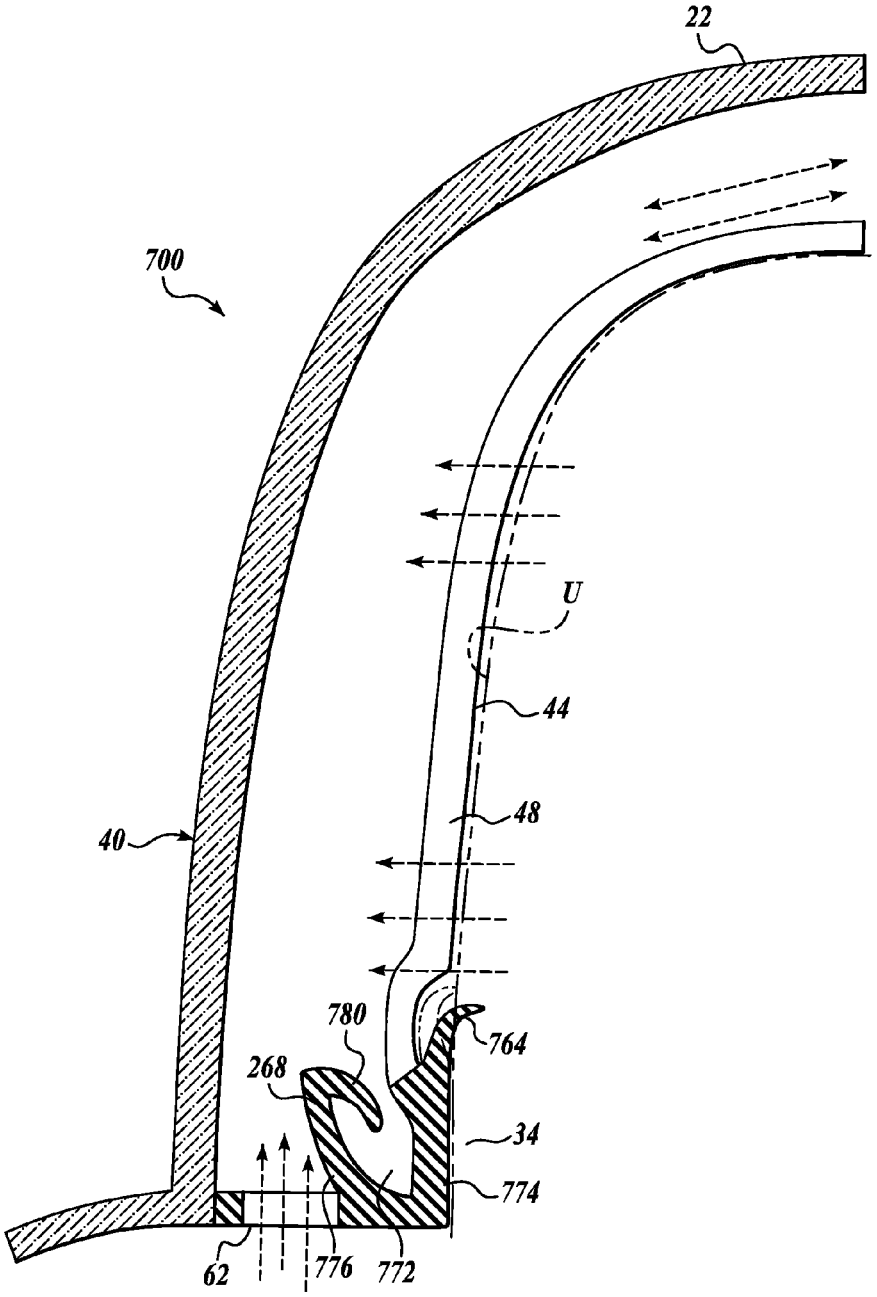
FIG. 17 is one example of a head covering, such as construction or "hard" hat, depicting a cross sectional view of one embodiment of a perspiration removal system in accordance with aspects of the present disclosure.

It will be appreciated that aspects of the present disclosure may find use in other head coverings, such as bandanas, visors, hard hats, etc. In the embodiment of FIG. 14, there is shown one example of a perspiration removal system 420 for removing moisture from the wearer. The perspiration gutter system 320 may be suitable for use in a bandana 400, as shown in the FIG. 14, a visor 500 (where the brim 24 is in the form of a bill), as shown in FIG. 15, a hat 600, as shown in FIG. 16, or a hard hat 700, as shown in FIG. 17.

As shown in FIG. 14, the perspiration removal system 420 includes a channel 472 formed between a lower inner wall section 474, which seats directly or indirectly against the forehead of the user U, and an outer wall section 476. The channel 472 extends around the outer perimeter of the inner wall section 474 or sections thereof. The perspiration removal system 420 further includes a "seal" or "skirt" element 464 coupled to, integrally formed with or otherwise disposed at the upper end of the inner wall section 474. The element 464 is a somewhat flexible member, and thus, moves between an unbiased state, as shown in solid lines in FIG. 14, and a biased stated when contacting the head of a user as shown in dashed lines in FIG. 14. In use, the element 464 aims to form a seal with the forehead of the user. In use, the element 464 aims to shelve water or perspiration over into the perspiration channel 472 in order to prevent it from draining down in between the inner wall and the wearers head, and possibly, into the wearer's eyes. In the embodiment shown, the skirt element 464 extends around the perimeter of the inner wall section 474 or sections thereof.

The perspiration removal system 420 in some embodiments also includes an upper inner wall section 478 arranged and configured to seat directly or indirectly against the forehead of the user at a location above the seal element 464. In these embodiments, seal element 464 is disposed between the lower and upper inner wall sections so that the water or perspiration that falls down the user's forehead is directed into the channel 472 by skirt element 464. In some embodiments, the perspiration removal system 420 includes an upper gutter portion or deflector 480 configured to retard, and in some embodiments restrict or prevent, liquid from dumping out from the channel 472 if the person were to bend over. The perspiration removal system 420 may further include an aperture 482 at the top thereof.

The bandana 400 in some embodiments includes an outer layer constructed of highly wicking fabric that covers the perspiration removal system 420. In these and other embodiments, the system 420 can be constructed of suitable fabric, plastic, or the like.

Figure 19:
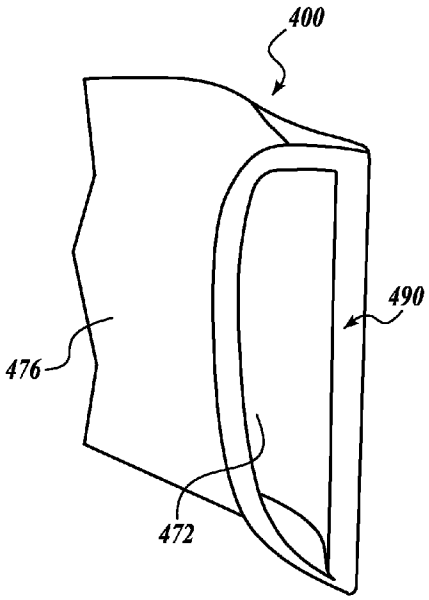
FIG. 19 is a partial end view of the perspiration removal system of FIG. 18.
Figure 18:
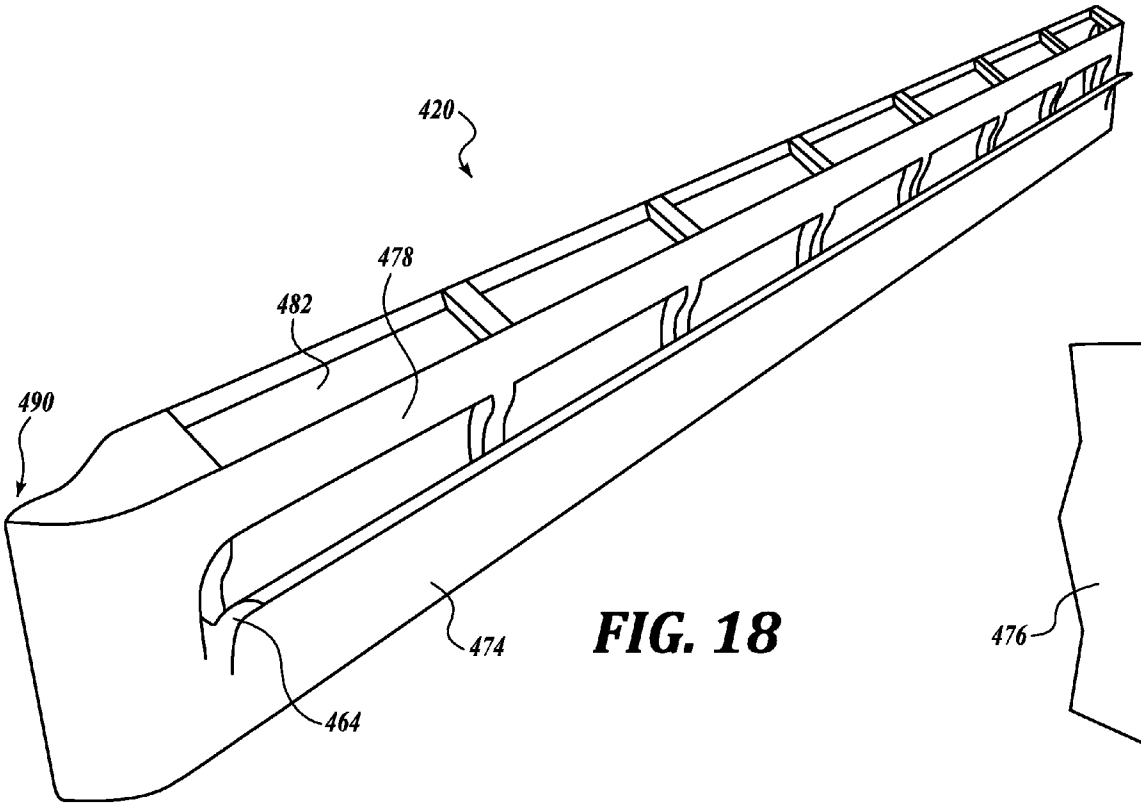
FIG. 18 is a perspective view of one example of the perspiration removal system of FIG. 14.

Turning now to FIGS. 18 and 19, the perspiration removal system 420 is configured to channel perspiration or other moisture (e.g., rain, etc.) that has collected in the channel 474 to, for example, the back of the bandana 400, where it is diverted via a diverter 490 toward the outer wall 476 and continuing exteriorly of the bandana 420. In that regard, the diverter 490 can be formed by or coupled to the inner wall section 474 and extends outwardly to the outer wall section 474 to an opening 492. As such, the diverter is configured to deposit the liquid away from the wearer's head.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the claimed subject matter. Accordingly, it is expressly intended that all such variations, changes, and equivalents fall within the spirit and scope of the claimed subject matter.

The embodiments of the disclosure in which an exclusive property or privilege is claimed are defined as follows:

1. A head covering comprising:

a crown having an open ended cavity configured to receive a head of a user, wherein the crown includes an inner crown wall disposed adjacent to a head of a user when the head covering is worn, an outer crown wall spaced a distance outwardly from the inner crown wall, and a top section, wherein the outer crown wall includes an upwardly extending first section and a second section that extends from an upper portion of the first section to one of the top section and the inner crown wall in an upwardly sloping manner;

a ventilation system associated with the crown and configured to provide ventilation to a user of the head covering, the ventilation system comprising at least one chamber disposed between the inner crown wall and the outer crown wall, at least one first chamber opening disposed in the inner crown wall and connecting the at least one first chamber in fluid communication with the open ended cavity, at least one second chamber opening disposed in the second section of the outer crown wall and connecting the at least one first chamber in fluid communication with an exterior of the head covering, and at least one third chamber opening disposed below the at least one chamber and connected in fluid communication with the at least one first chamber.

2. The head covering of claim 1, further including one of a brim and a bill, wherein the at least one third chamber opening is disposed in said one of the brim and the bill.

3. The head covering of claim 1, further comprising a gutter element disposed on a substantially occluded portion of the second section of the outer crown wall and is positioned outwardly of the second chamber opening.

4. The head covering of claim 3, wherein the top section extends outwardly of one of the gutter element and the second chamber opening, and wherein the outer crown wall includes a third section extending from the intersection of the first and second sections, the third section including at least one area of mesh and the first section being substantially occluded.

5. The head covering of claim 1, further comprising an outer channel wall section disposed radially outwardly of the inner crown wall and coupled thereto in order to form a channel;

a flexible seal element associated with a portion of the inner crown wall, the flexible seal having a surface capable of diverting liquid into the channel;

wherein the flexible seal element is configured to be moved between an unbiased state in which the flexible seal extends inwardly of the inner crown wall and into the open ended cavity and a biased state, in which the flexible seal element is in contact with the head of the user.

6. The head covering of claim 1, wherein the top section extends outwardly of the second chamber opening, and wherein the outer crown wall includes a third section extending from the intersection of the first and second sections and interfacing with the top section, the third section including means for permitting air flow through the third section.

7. The head covering of claim 1, further comprising a strap associated with the crown, the strap configured to interface with a head of a user for retaining the hat thereon.

8. The head covering of claim 1, further comprising hat retaining means, wherein the hat retaining means is coupled to the crown of the hat and extends below the crown of the hat.

9. The head covering of claim 1, wherein the outer crown wall is constructed from at least one material including fabric.

10. The head covering of claim 5, further comprising a deflector extending inwardly of the outer wall section into the channel, the deflector positioned a spaced distance above a bottom the channel.

11. The head covering of claim 5, further comprising means for directing the liquid to a location externally of the head covering.

12. A head covering, comprising:

a hat body having a brim and a crown, the crown including an inner wall and an outer wall spaced a distance outwardly from the inner wall, wherein the brim extends around at least a portion of a lower portion of the crown;

a ventilation system associated with the crown and configured to provide ventilation to a user of the head covering, the ventilation system comprising a first chamber disposed between the inner wall and the outer wall, at least one first chamber opening disposed in the inner wall and configured to connect the first chamber in fluid communication with an open ended cavity formed by the crown, at least one second chamber opening disposed in the outer wall and configured to connect the first chamber in fluid communication with an exterior of the head covering, and at least one third chamber opening disposed in the brim and connected in fluid communication with the at least one first chamber; and means for collecting moisture when the head covering is being worn.

13. The head covering of claim 12, further comprising means for transporting the moisture to a location external the head covering.

14. The head covering of claim 12, wherein the said means for collecting moisture includes a first channel disposed adjacent the inner wall of the crown and extending along at least a section thereof, the head covering further comprising a second channel connected in fluid communication with the first channel and extending radially outwardly from the first channel along the brim to an outward edge of the brim.

15. The head covering of claim 6, wherein the inner crown wall is configured to permit air flow that flows through the third section, via said means for permitting air flow, into the open ended cavity.

16. The head covering of claim 7, wherein the strap is size adjustable.

17. The head covering of claim 7, wherein the strap includes an outer strap body having first and second ends that are anchored adjacent the inner crown wall, the outer strap body forming a channel that extends along the length of the strap, and first and second strap sections discrete from and movable with respect to the outer strap body, the first and second strap sections disposed within the channel with first ends of the first and second strap sections anchored adjacent the inner crown wall and second ends having cooperating adjustable fastening means.

18. A head covering comprising:

a crown having an open ended cavity configured to receive a head of a user, wherein the crown includes an upwardly extending inner wall section disposed adjacent to a head of a user when the head covering is worn, an upwardly extending outer wall section spaced a distance outwardly from the inner wall section, a top section disposed generally transverse to the inner wall section, and a cross member section that extends from an upper portion of the outer wall section to one of the top section and the inner wall section in an upwardly sloping manner;

a brim that extends around at least a portion of a lower portion of the crown;

a ventilation system associated with the crown and configured to provide ventilation to a user of the head covering, the ventilation system comprising at least one chamber disposed between the inner wall section and the outer wall section, at least one first chamber opening disposed in the inner wall section and connecting the at least one first chamber in fluid communication with the open ended cavity, at least one second chamber opening disposed in the cross member section and connecting the at least one first chamber in fluid communication with an exterior of the head covering, and at least one third chamber opening disposed below the at least one chamber and connected in fluid communication with the at least one first chamber.

19. The head covering of claim 9, wherein at least one of the first section and the second section of the outer crown wall is occlusive.

20. The head covering of claim 9, wherein a section of the inner crown wall is rigid or semi-rigid.

* * * * *